US011718122B2

(12) United States Patent
McGruder

(10) Patent No.: US 11,718,122 B2
(45) Date of Patent: Aug. 8, 2023

(54) NOTEPAD WITH MULTI-HINGED BACKING PANEL

(71) Applicant: John Nary McGruder, San Diego, CA (US)

(72) Inventor: John Nary McGruder, San Diego, CA (US)

( * ) Notice: Subject to any disclaimer, the term of this patent is extended or adjusted under 35 U.S.C. 154(b) by 0 days.

(21) Appl. No.: 17/727,711

(22) Filed: Apr. 23, 2022

(65) Prior Publication Data

US 2023/0029831 A1 Feb. 2, 2023

Related U.S. Application Data

(60) Provisional application No. 63/152,801, filed on Feb. 23, 2021.

(51) Int. Cl.
*B42D 5/00* (2006.01)

(52) U.S. Cl.
CPC ..... *B42D 5/005* (2013.01)

(58) Field of Classification Search
CPC ..... B42D 5/005; B42D 5/003; B42D 5/006
USPC ..... 281/3.1, 15.1, 44, 45; 40/726; 283/63.1, 283/64
See application file for complete search history.

(56) References Cited

U.S. PATENT DOCUMENTS

| | | | | |
|---|---|---|---|---|
| 4,610,392 | A * | 9/1986 | DaRosa | B42F 7/04 281/44 |
| 5,494,366 | A | 2/1996 | Pell et al. | |
| 5,904,374 | A | 5/1999 | Lee | |
| 2002/0023314 | A1 | 2/2002 | Goldsmith et al. | |
| 2015/0314627 | A1 | 11/2015 | Latosquin | |

FOREIGN PATENT DOCUMENTS

| | | | |
|---|---|---|---|
| FR | 1113478 | A | 3/1956 |
| WO | 2005023556 | A1 | 3/2005 |

OTHER PUBLICATIONS

International Search Report and Written Opinion dated Sep. 2, 2022 for International Patent Application No. PCT/US22/26067 (20 pages).

* cited by examiner

*Primary Examiner* — Justin V Lewis
(74) *Attorney, Agent, or Firm* — Perkins Coie LLP

(57) ABSTRACT

A hinged panel system includes a multi-hinged backing panel assembled with a plurality of hinge flanges comprising at least a first hinge flange and a second hinge flange and a plurality of hinges comprising a first hinge and a second hinge, an authoring medium; wherein the multi-hinged backing panel and the authoring medium are connected a binding support that is configured to hold the multi-hinged backing panel and the authoring medium and a top covering the multi-hinged backing panel and the authoring medium.

22 Claims, 35 Drawing Sheets

Unit 1

Unit 2

Unit 3

Unit 3

Unit 3

Unit 4

Unit 4

Unit 4

Unit 5

Unit 5

Unit 5

Unit 6

Unit 6

Unit 7

Unit 7

Unit 7

Unit 8

Unit 8

Unit 8

Unit 9

Unit 9

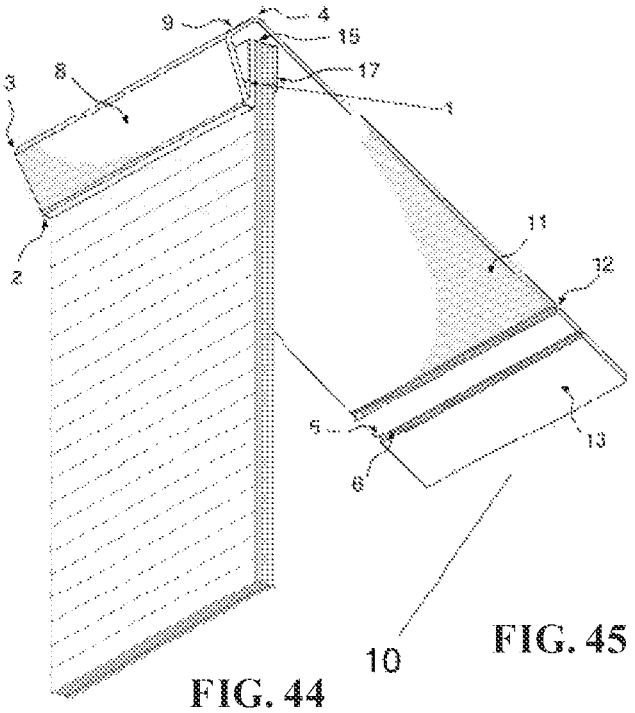
FIG. 44
FIG. 45
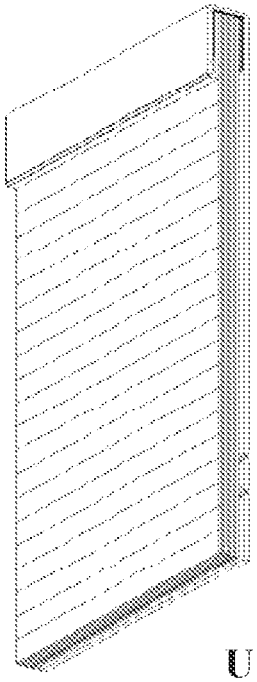
Unit 9

NOTEPAD WITH MULTI-HINGED BACKING PANEL

CROSS-REFERENCE TO RELATED APPLICATION(S)

The present application claims, under the restoration of priority rights pursuant to 37 C.F.R. § 1.78(b), the priority to and benefits of U.S. Provisional Application No. 63/152,801, entitled "NOVEL REVERSIBLE NOTEPAD WITH MULTI-HINGED BACKING PANEL PROVIDING FULL USE OF THE OBSERVED AND UNOBSERVED WRITING SURFACE" filed Feb. 23, 2021, which is incorporated herein by reference in its entireties for all purposes.

TECHNICAL FIELD

The field of the present document relates generally to a notepad in which the pages cannot be replaced and/or resorted, and where the notepad backing can be reverse folded/rotated such that the unobserved authoring medium surface can be made available for use.

BACKGROUND

Known notepads have a permanent fixed backing panel that is bond to a stack of authoring medium (notepad paper). For example, a common notepad can comprise a set of blank or ruled authoring medium (with an optional perforation for easy permanent removal of one or more pages) bound to a backing panel, which is typically a piece of cardboard of the same size, width and length, as the notepad papers.

The construction of a typical notepad is made for production and minimum bulk since the notepads are slightly thicker than the stack of authoring medium they contain, and typically no greater in length and width. Once the observed side of the authoring medium is used, the notepad's functionality is completed. The reverse side of the authoring medium is seldomly used in its entirety because there is no structural surface to support its use. If the reverse side of the authoring medium is used, it must first be rolled over, the cardboard backing extended out, doubling the notepad length, then held down with one hand to provide support for the authoring medium surface.

Therefore, it is desirable to provide an improved notepad with a reversible multi-hinged backing panel that allows the unobserved side of the authoring medium to be structurally supported. By supporting the notepad's authoring medium, with the multi-hinged backing panel, the unobserved notepad's authoring medium can be fully utilized with the same intended efficiency, while maintaining a minimal profile, similar to known notepads.

SUMMARY

The present document comprises a novel notepad being comprised of a multi-hinged backing panel that can support a plurality of authoring medium bonded, or otherwise connected, that can have binding support, and topper. The hinge backing panel system comprises a first portion (multi-hinged backing panel) connected to a second portion (authoring medium), connected to a third portion (binding support), held together by a fourth portion (integrated inserts, staples, adhesive tape strip, hook and loop, adhesives, magnets, or binding materials) covered by a fifth portion (topper).

The width of the multi-hinged backing panel is approximately equal to the width of the authoring medium. The length of the multi-hinged backing panel is generally equal to the length of the authoring medium terminating at the distal end (bottom end) of hinge flange 11. When the multi-hinged backing panel does not comprise an index assembly element, as described in some of the embodiments, the length of the backing panel will be greater than the length of the notepad authoring medium. The added length can form an index assembly element being comprised of hinge flange 5 (that approximates the thickness of the authoring medium 21), hinge 6, hinge 12, and hinge flange 13. Hinge flange 1 and hinge flange 8 can have equal length and width. Hinge flange 11 will terminate at the distal (bottom end) of the authoring medium 21, above hinge 12. When the multi-hinged backing panel 10 is reverse folded/rotated, index assembly element (hinge flange 5, hinge 6, hinge 12, and hinge flange 13) will lay flush against the authoring medium 21. The distal end (bottom end) of hinge flange 13 will align with the distal end (bottom end) of authoring medium 21.

The multi-hinged backing panel can be reverse folded/rotated to expose the unobserved authoring medium surface. Hinge 12, hinge 6, hinge flange 5, and hinge flange 13 will support the authoring medium. The distal end (bottom) of hinge flange 13 will align with the distal end (bottom) of authoring medium 21. The index assembly element can then align with the bottom edge of the multi-hinged backing panel. When reversed folded/rotated, one of the methods described in the embodiments, to secure the backing panel to the authoring medium, can be used. If the index assembly element is not included in the multi-hinged backing panel, the multi-hinged backing panel, when folded/rotated, will not fully cover and support entire length of the authoring medium. It is therefore desirable, but not required, to include the index assembly element.

The multi-hinged backing panel can have a plurality of hinges and hinge flanges. The hinges can rotate up to 360 degrees but can be limited to 90 and 180 degrees. The hinges are generally created as a scored, perforated, or grooved horizontal or vertical line on one or both sides bilaterally depending on the thickness of the backing panel. Scoring is used to form grooves into the hinged backing panel that are deep enough to create rotatable hinges. Hinge flange can rotate along the axis of hinge such that the hinge flange can lay flush when rotated 180 degrees. Other hinge designs are possible (e.g., perforation, overlays, slit cuts, etc.). Additionally, the multi-hinge backing panel can have connectives such as adhesive tape strip, hook and loop, magnets, etc. that is generally centered on the hinge flange. The connective is generally positioned above or below the hinge associated with the hinge flange to which the hinge is attached. A connective such as an adhesive tape strip can be attached to the hinge flange and can extend out from both sides of the hinge flange that it is attached to, up to a distance that can be approximately equal to the length of the hinge flange or any distance in-between.

In one example aspect, a hinge backing panel system is disclosed. The hinge backing panel system includes a multi-hinged backing panel assembled with a plurality of hinge flanges and a plurality of hinges; an authoring medium; wherein the multi-hinged backing panel and the authoring medium are connected; a binding support that is configured to hold the multi-hinged backing panel and the authoring medium; and a top covering the multi-hinged backing panel and the authoring medium.

In one example aspect, a multi-hinged panel is disclosed. The multi-hinged panel includes a first elongated rectangular-shaped hinge flange; a first hinge; wherein one side of the first elongated rectangular-shaped hinge flange is connected to one side of the first hinge; a second elongated rectangular-shaped hinge flange; wherein one side of the second elongated rectangular-shaped hinge flange is connected to the opposite side of the first hinge: a second hinge; wherein the opposite side of the second elongated rectangular-shaped hinge flange is connected to one side of the second hinge; a third elongated rectangular-shaped hinge flange; wherein one side of the third elongated rectangular-shaped hinge flange is connected to the opposite side of the second hinge: a third hinge; wherein the opposite side of the third elongated rectangular-shaped hinge flange is connected to one side of the third hinge; a fourth elongated rectangular-shaped hinge flange; wherein one side of the fourth elongated rectangular-shaped hinge flange is connected to the opposite side of the third hinge.

In one embodiment two integrated locking assembly components extend away from the main body of the multi-hinged backing panel on the length side of the backing panel and are located on opposite sides below the third hinge (4). When not in use, the integrated locking assembly is generally folded/rotated onto the face of the unobserved multi-hinged backing panel below the unobserved pages or onto the face of the observed multi-hinged backing panel and generally held in place by a connective such as a repositioning adhesive. When the multi-hinged backing panel is reversed folded/rotated, the locking hinges tongue inserts (27) are slotted (nested) between hinge flange (1) and hinge flange (8).

In other embodiment, where a locking mechanism is not used, the connectives (e.g., adhesive tape strip, hook and loop, adhesives, etc.) are attached to the observed side of the hinge flange and when not in use the connective's extension can be folded/rotated either underneath the authoring medium, or onto the observed face of the hinge flange to which it is associated and can be held in place by a repositioning adhesive. Generally, the connectives are positioned parallel to and either above or below the hinge that it is associated with.

The hinges can generally have single or double-sided rotating capability. This is determined by the thickness of the multi-hinged backing panel. For example, a thicker multi-hinged backing panel can require double-sided hinge rotation and a thinner backing panel can require a single side hinge rotation, but may also have a double sided hinge to make rotation easier. The hinge construction can consist of perforation, scoring, or other mechanics that will optimize rotation.

The multi-hinged backing panel can also include a hinged backing panel being comprised of a width dimension and length dimension approximately equal to the width and length of the notepad's authoring medium that it is attached to, but is not limited to such. For example, the length of the multi-hinged backing panel can be intended beyond the length of the authoring medium to include an index assembly element. The multi-hinged backing panel can be substantially more ridged than a sheet of notepad's authoring medium. For example, the multi-hinged backing can be made of material such as chipboard, paperboard, heavy cardstock etc. The multi-hinged backing panel can comprise an index assembly element that is generally contiguous to the hinge-backing panel, but it can be added separately.

The multi-hinge backing panel notepad assembly can comprise an authoring medium surface including a plurality of authoring medium. The authoring medium for example can be a width and length approximately equal to the width and length of the multi-hinged backing panel and visa-versa. The multi-hinged backing panel can have a width approximately equal to the width of the multi-hinged backing panel unit and a length approximately equal to the length of the notepad's authoring medium when reversed folded/rotated or it can be made without an index assembly element. When made without the index assembly element, the multi-hinged backing panel will fold as described, but it will not extend to the length of the notepad because the index assembly element was not included in the construction. In some instances, the locking tabs may also be eliminated. This method is generally used as a less expensive alternative as the tooling to produce an index assembly element and integrated locking assembly is eliminated.

The above and other aspects and their implementations are described in greater detail in the drawings, the descriptions, and the claims.

BRIEF DESCRIPTION OF THE DRAWINGS

The foregoing summary, as well as the following detailed description of the exemplary embodiments, will be better understood when read in conjunction with the appended drawings. It should be understood, however, that the document is not limited to the precise arrangements and instrumentalities shown in the following figures:

FIG. 44 is a perspective partial reverse fold view of an assembled notepad with hinged baking panel constructed according to an exemplary embodiment.

FIG. 45 is a front perspective view of a reversed folded/rotated assembled notepad with multi-hinged backing panel constructed according to an exemplary embodiment.

DETAILED DESCRIPTION

Section headings are used in the present document only to improve readability and do not limit scope of the disclosed embodiments and techniques in each section to only that section.

Throughout the following description specific details are set forth in order to provide a more thorough understanding to persons skilled in the art. However, well-known elements may not have been shown or described in detail to avoid unnecessarily obscuring the disclosure. Accordingly, the description and drawings are to be regarded in an illustrative, rather than a restrictive or exclusive, sense.

Any and/or all of the references specifically identified in the detailed description section of the present application are expressly incorporated herein in their entirety by reference thereto. The term "about", "approximates", and "approximately," as used herein, should generally be understood to refer to both the corresponding number and a range of numbers. Moreover, all numerical ranges herein should be understood to include each whole integer within the range. Also, authoring medium, adhesives, adhesive strips, multi-hinged backing panel, index assembly element, staples, hook and loop, magnets, ferromagnetic plate, and other materials can be of any size, shape, and/or material, including standard paper sizes, e.g., letter, legal, A4, etc. The term "folding, "inverse" and "reverse" as used herein, should generally be understood to be interchangeable and refer to rotating a hinge flange along a hinge axis. The term "length" refers to the longer side of a rectangle and the term "width" refers to the shorter side of a rectangle. The term "height" can refer to both the vertical length of a rectangle and the vertical width of a rectangle.

Additionally, references to "360 degree(s)", "90 degree (s)", and "180 degree(s)" as used herein, should generally be understood to refer to the minimum rotation obtainable, although greater and lesser rotations are possible as dictated by the requirements for the rotation (e.g., hinge 4 requires a 90 degree rotation). In this example only one side of the multi-hinge backing panel will need a single-sided hinge, but may require a two-sided hinge depending on the thickness of the backing panel. Rotations that are greater than 90 degrees can require a two-sided hinge but are not limited to such. The multi-hinged backing panel can be landscape or portrait.

While illustrative embodiments are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present document.

Exemplary Embodiment 1

Figure 1:
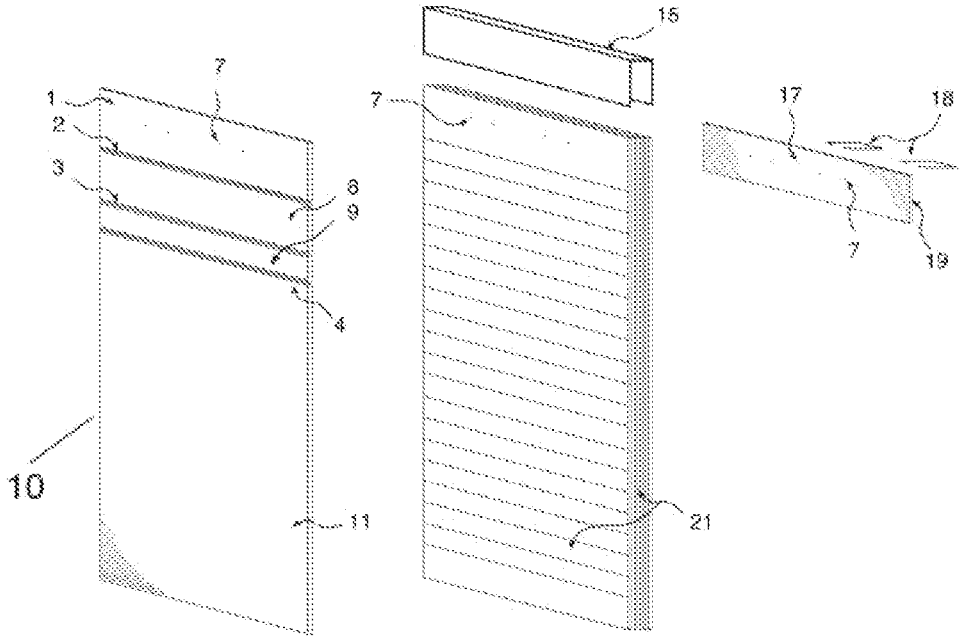
FIG. 1 is an explosive perspective view of the multi-hinged backing panel and notepad constructed according to an exemplary embodiment.

Referring to FIG. 1 an exploded perspective view of an unassembled notepad with multi-hinged backing panel. The notepad can incorporate a multi-hinged backing panel 10 being comprised of hinge flange 1, hinge 2, hinge flange 8, hinge 3, hinge flange 9, hinge 4, hinge flange 11 and authoring medium 21. The authoring medium 21 is generally equal in length and width as the multi-hinged backing panel. The notepad can be assembled to include a first binding portion 17 connected to a second binding portion 21 (authoring medium that is generally pre-assembled), connected to a third binding portion 10 (multi-hinged backing panel). In this embodiment section 17, 21 and 10 are held together with staples 18 but not limited to such as other connectives are possible. The assembled notepad is then covered over with a topper 15.

Figure 2:
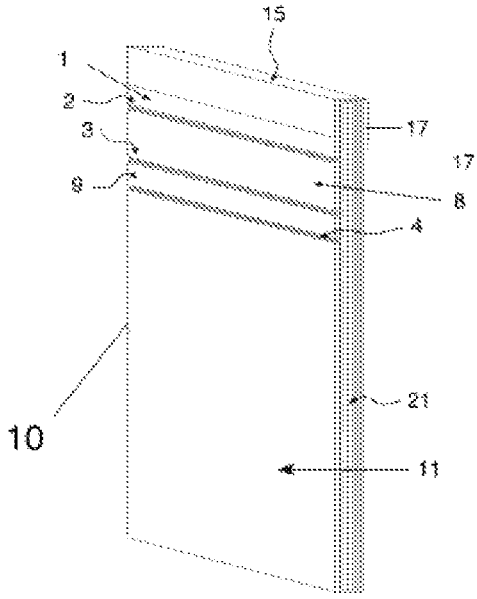
FIGS. 2 and 3 are perspective back and front views of an assembled notepad with multi-hinged backing panel.
Figure 3:
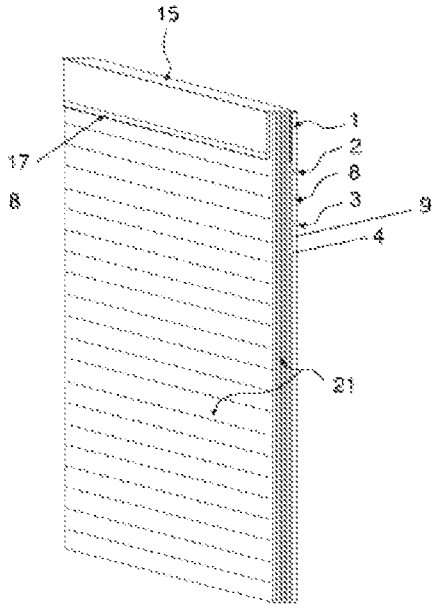

Referring to FIGS. 2 and 3, unit 1, are back and front perspective views of an assembled notepad with multi-hinged backing panel 10. On the assembled notepad, hinges 2, 3, 4 and hinge flange 1, 8, 9, and 11 are in a resting position (unfolded/non-rotated) on the multi-hinged backing panel 10. Binding support 17, authoring medium 21, and the multi-hinged backing panel are held together by staple connectives 18 (not shown here). This grouping is then covered with a topper 15. The authoring medium 21 is generally the same dimensions, length and width, as the multi-hinged backing panel. The authoring medium terminates at the distal end (bottom end) of hinge flange 11.

Figure 4:
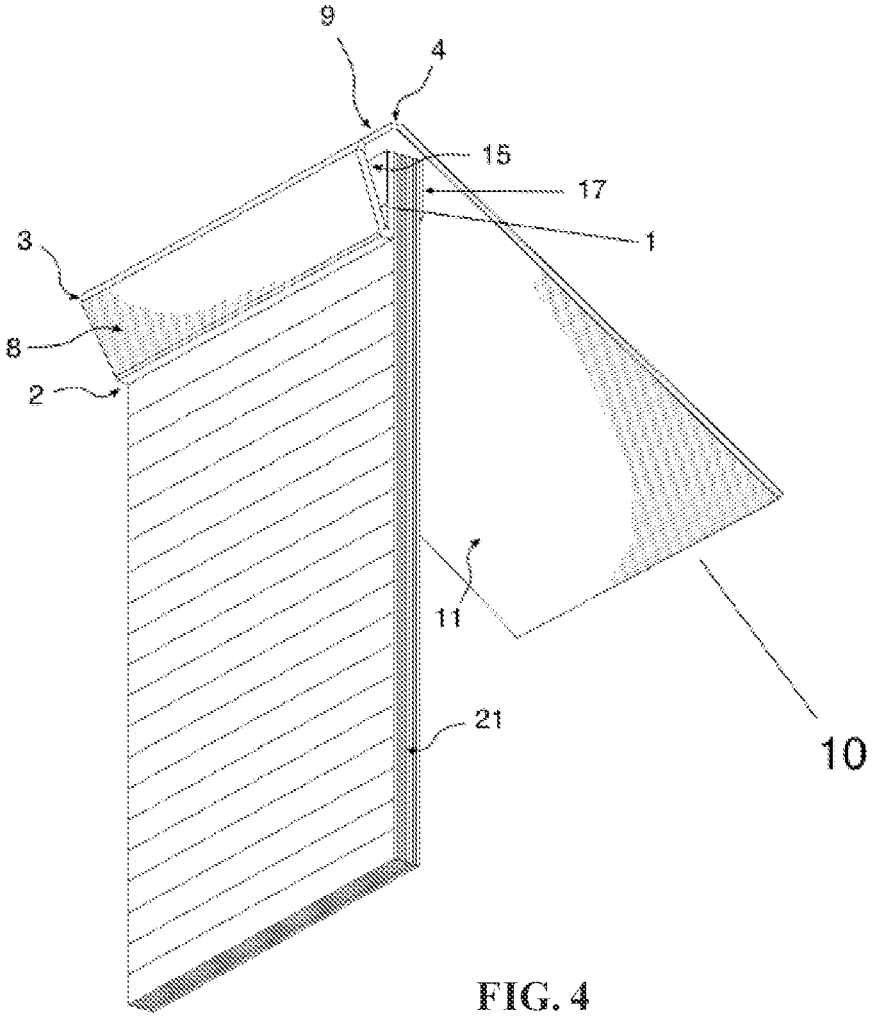
FIG. 4 is a perspective partial reverse fold view of an assembled notepad with multi-hinged baking panel.

Referring to FIG. 4 is a perspective view of a partially folded/rotated assembled notepad. In this embodiment the multi-hinged backing panel 10 is rotated up, along hinge 2's axis. Hinge flange 8 will then lay flush against hinge flange 1. Hinge flange 9 is rotated 90 degrees along hinge 3's axis. The width of hinge flange 9 approximates the aggregate thickness of authoring medium 21, binding support 17, hinge flange 1, and topper 15. Hinge flange 9 will lay flush against the top edge of hinge flange 1, the top edge of binding support 17, the top edge of the authoring medium, and topper 15. Hinge flange 11 will rotate 90 degrees down along hinge 4's axis and will lay flush against authoring medium 21. In this embodiment the distal end (bottom end) of hinge flange 11 will not align with the distal end (bottom end) of authoring medium 21. However, hinge flange 11 will provide support for the authoring medium 21.

Figure 5:
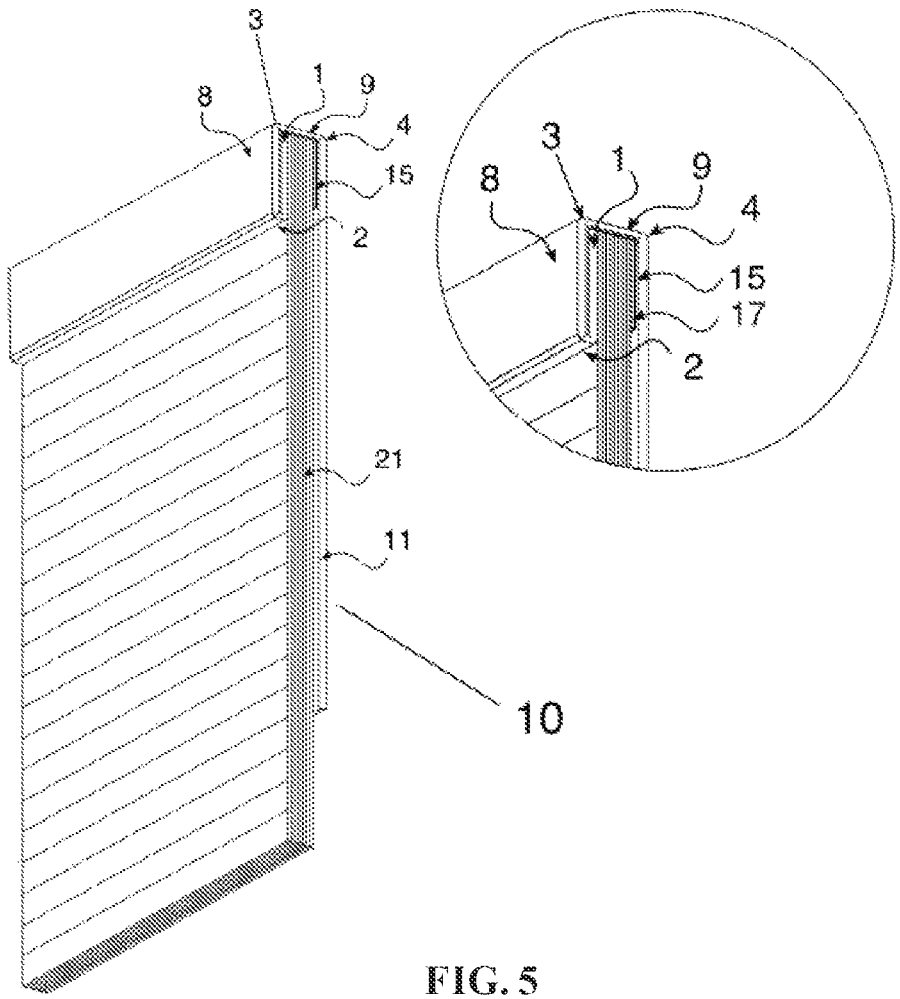
FIG. 5 is a front perspective view of a reversed folded/rotated assembled notepad with multi-hinged backing panel constructed according to an exemplary embodiment.

Referring to FIG. 5 is a front perspective view of a reverse folded/rotated assembled notepad with a multi-hinged backing panel 10. In this embodiment the multi-hinged backing panel 10 is rotated up along hinge 2's axis. Hinge flange 8 lay flush against hinge flange 1. Hinge flange 9 is rotated 90 degrees along hinge 3's axis. The width of hinge flange 9 approximates the aggregate thickness of authoring medium 21, hinge flange 1, binding support 17, and topper 15. Hinge flange 9 is flush against the top edge of hinge flange 1, the top edge of binding support 17, the top edge of the authoring medium, and topper 15. Hinge 11 is rotated 90 degrees down along hinge 4's axis and lay flush against authoring medium 21.

Exemplary Embodiment 2

Figure 6:
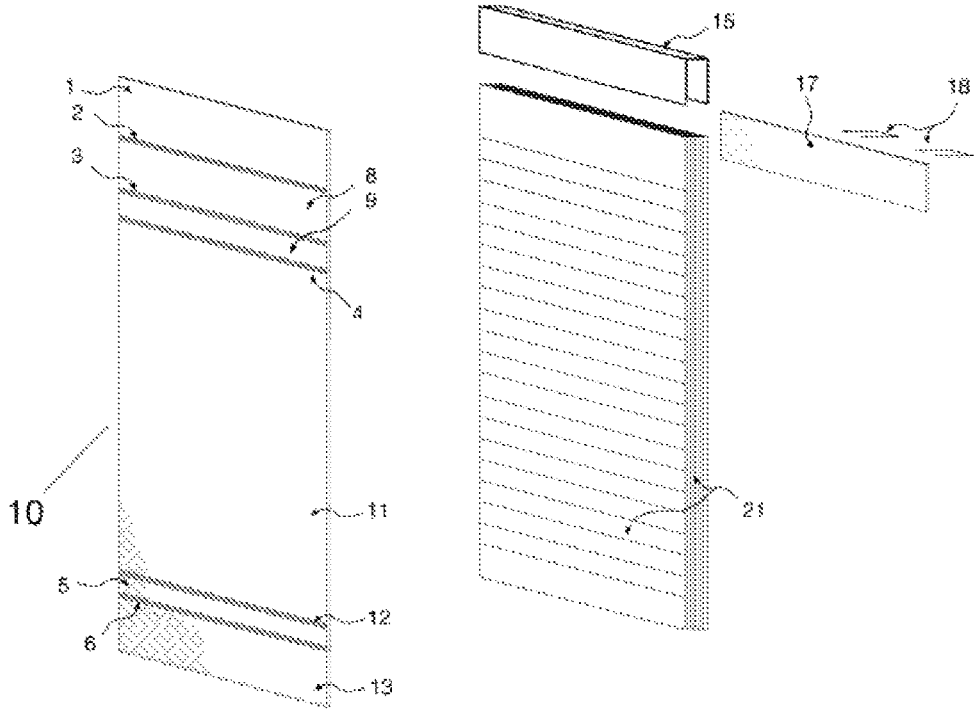
FIG. 6 is an explosive perspective view of the multi-hinged backing panel and notepad constructed according to an exemplary embodiment.
Figure 9:
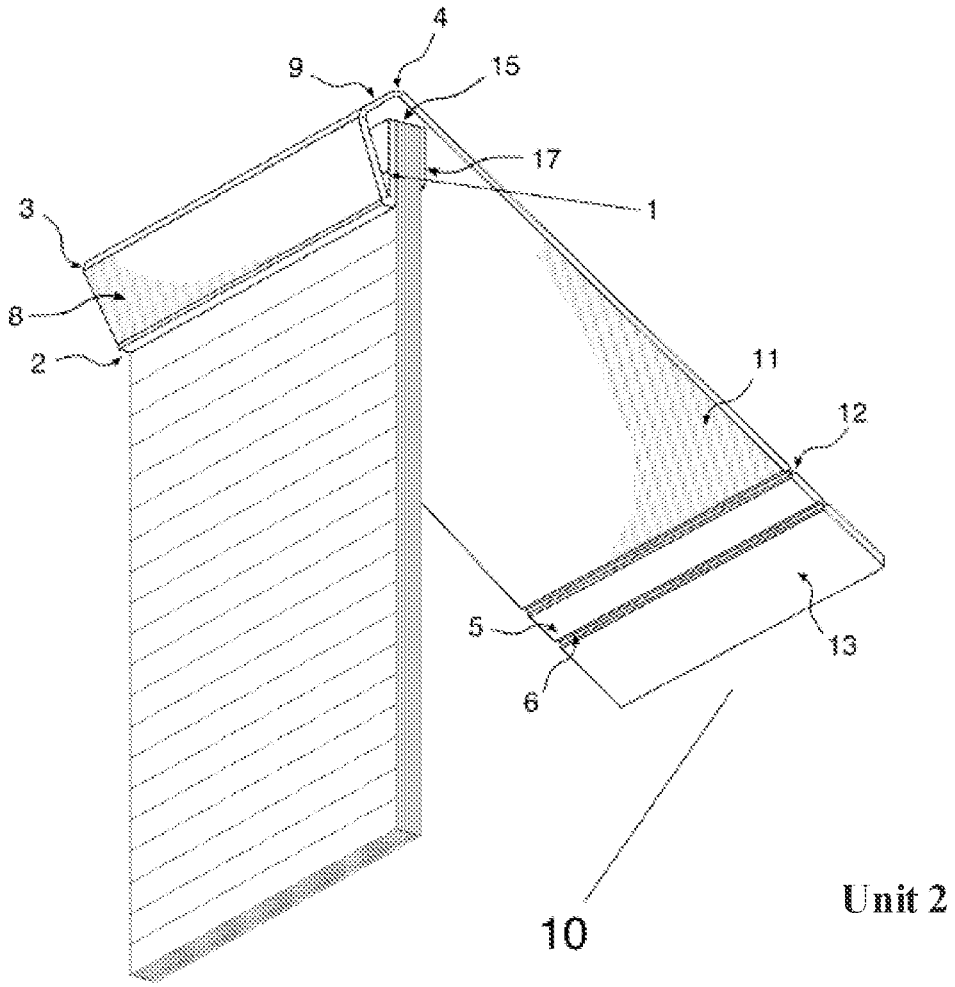
FIG. 9 is a perspective partial reverse fold view of an assembled notepad with hinged baking panel.

Referring to FIG. 6 an exploded perspective view of an unassembled notepad with multi-hinged backing panel 10. The exploded view includes a multi-hinged backing panel 10 being comprised of hinge flange 1, hinge 2, hinge flange 8 hinge 3, hinge flange 9, hinge 4, hinge flange 11, hinge 12, hinge flange 5, hinge 6, hinge flange 13, and a authoring medium 21. FIG. 9 shows a binding support 17 that connects to authoring medium 21 (that is generally pre-assembled) that connects to multi-hinged backing panel 10. Staples 18 hold binding support 17, authoring medium 21, and multi-hinged backing panel 10 together. This assembled section can then be covered over with topper 15.

Figure 7:
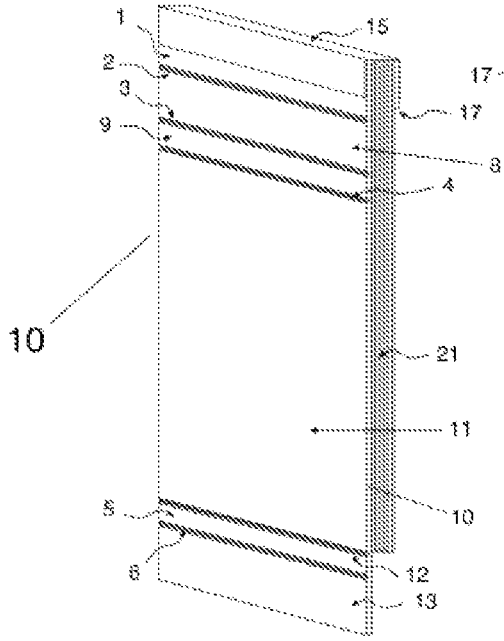
FIGS. 7 and 8 are perspective back and front views thereof an assembled notepad with multi-hinged backing panel.
Figure 8:
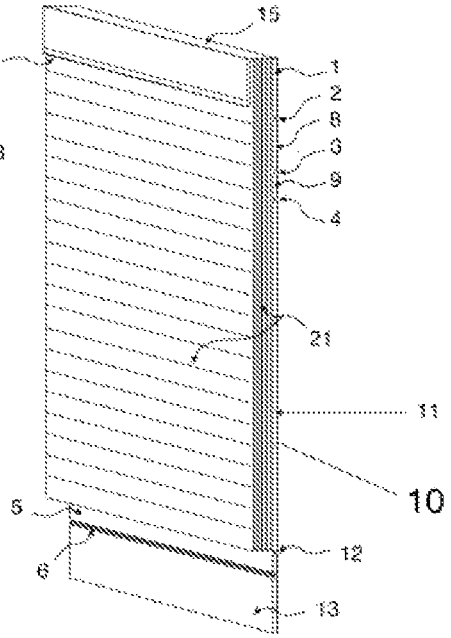

Referring to embodiment 2, FIGS. 7 and 8 are back and front and back perspective views of an assembled notepad with multi-hinged backing panel 10. On the assembled notepad, hinges 2, 3, 4, 6 and 12; hinge flange 1, 8, 9, 11, and 13 are in resting (neutral) position on the multi-hinged backing panel 10. Staples 18 (not shown here) hold binding support 17, authoring medium 21, and multi-hinged backing panel 10 together. This assembled section can then be covered over with topper 15. The authoring medium 21 terminates at the distal end (bottom end) of hinge flange 11 and is generally the same length as the aggregate width of hinge 1, hinge flange 2, hinge 8, hinge 3, hinge flange 9, hinge 4 and the length of hinge flange 11.

Referring to FIG. 9, unit 2 is a perspective view of a partially reverse folded/rotated assembled notepad with multi-hinged backing panel 10. In this embodiment the multi-hinged backing panel 10 is rotated up 180 degrees along hinge 2's axis. Hinge flange 8 lay flush against hinge flange 1. Hinge flange 9 is rotated 90 degrees along hinge 3's axis. The width of hinge flange 9 approximates the aggregate thickness of the authoring medium 21, hinge flange 1, the binding support 17, and topper 15. Hinge flange 9 will lay flush against the top edge of hinge flange 1, the top edge of binding support 17, the top edge of authoring medium 21, and topper 15. Hinge 11 is rotated 90 degrees down along hinge 4's axis. When the notepad is reversed folded/rotated, the multi-hinged backing panel 10, specifically the distal end (bottom) of hinge flange 13, will align with the distal end (bottom) of the authoring medium 21. Hinge flange 11, hinge 12, hinge flange 5, hinge 6, and hinge flange 13 will lay flush against the authoring medium 21.

Figure 10:
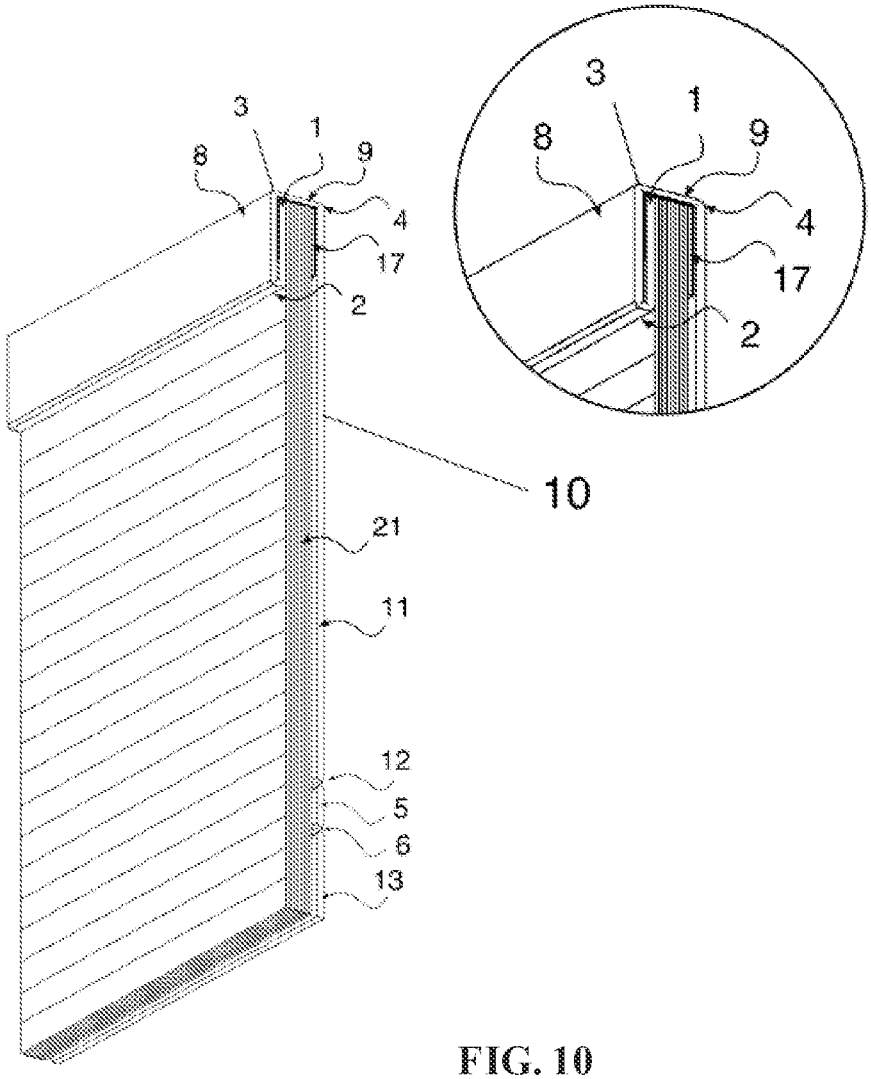
FIG. 10 is a front perspective view of a reversed folded/rotated assembled notepad with multi-hinged backing panel constructed according to an exemplary embodiment.

Referring to FIG. 10 a perspective front view of a reversed folded/rotated notepad with multi-hinge backing panel. Hinge flange 8 is rotated up to 180 degrees along hinge 2's axis. Hinge flange 8 lay flush against hinge flange 1. Hinge flange 9 is rotated over 90 degrees along hinge 3's axis. The width of hinge flange 9 approximates the aggregate thickness of the authoring medium 21, hinge flange 1, the binding support 17, and the topper 15. Hinge flange 9 lay flush against the tops of hinge flange 1, the binding support 17, and the topper 15. Hinge 11 is rotated 90 degrees down along hinge 4's axis. Hinge flange 11, hinge 12, hinge flange 5, hinge 6, and hinge flange 13 lay flush against the authoring medium 21.

Exemplary Embodiment 3

Figure 11:
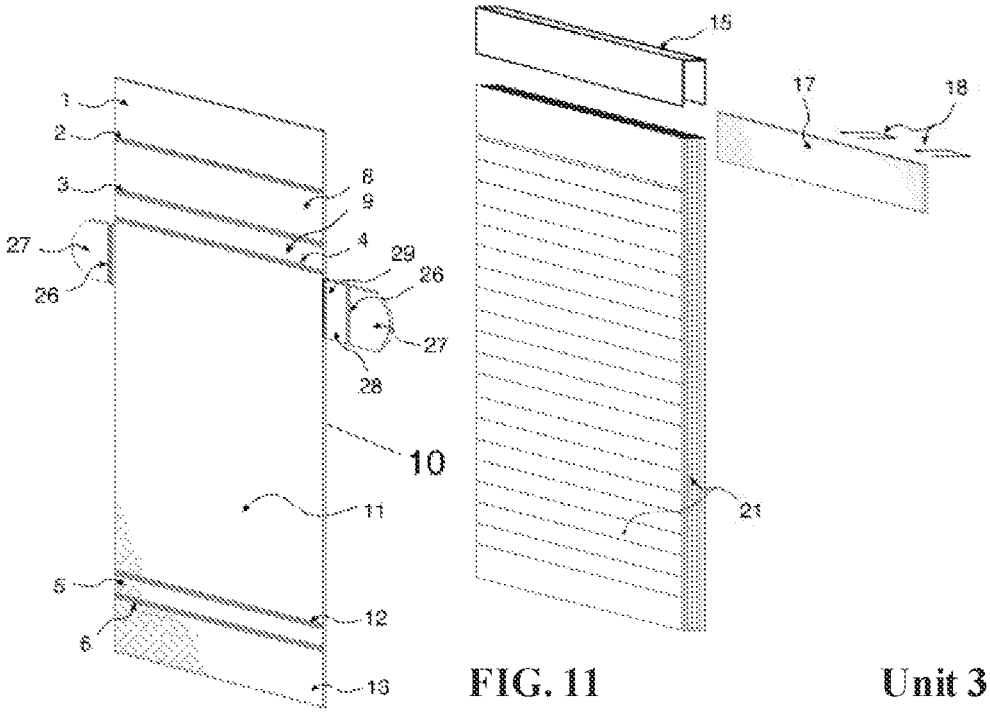
FIG. 11 is an explosive perspective view of the multi-hinged backing panel and notepad constructed according to an exemplary embodiment.

Referring to FIG. 11 unit 3 an exploded view includes a multi-hinged backing panel 10 with hinge flange 1, hinge 2, hinge flange 8, hinge 3, hinge flange 9, hinge 4, and hinge flange 11; A locking assembly 40 being comprised of hinge 26, hinge flange insert inserts (27 and 64), hinge flange 28, hinge 65, and hinge 29. The locking assembly 40 is positioned on both length sides of the hinged backing panel directly below hinge 4; and an index assembly element (hinge flange 5, hinge 6, hinge 12, and hinge flange 13). FIG. 11 comprises an authoring medium 21, a binding support 17, staples 18, topper 15, and an index assembly element (hinge flange 5, hinge 6, hinge 12, and hinge flange 13).

Figure 12:
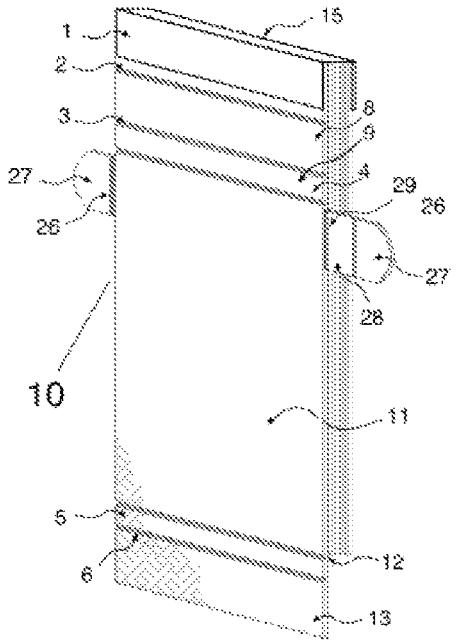
FIGS. 12 and 13 are perspective back and views thereof an assembled notepad with multi-hinged backing panel.
Figure 13:
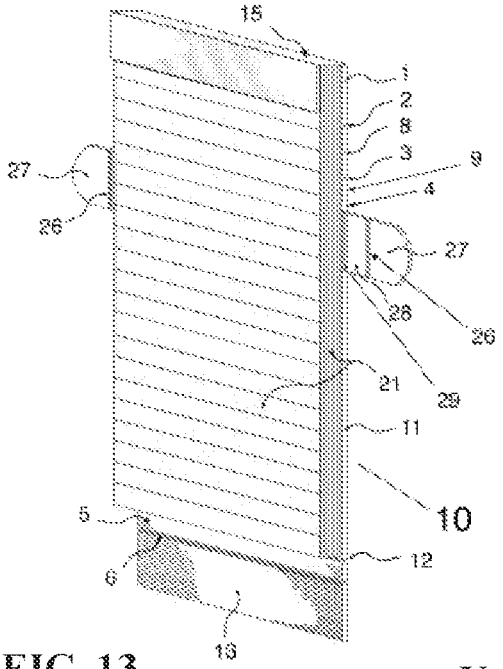

Referring to FIGS. 12 and 13, unit 3. The back and front view of an assembled notepad can be comprised of a support portion 17 connected to authoring medium 21, connected to the multi-hinged backing panel 10. The group is held in place by staples 18 and a topper cover 15. The multi-hinged backing panel 10 is comprised of hinges 2, 3, 4, 12, 6 and hinge flanges 1, 8, 9, 11, 5, and 13. The multi-hinged backing panel 10 can comprise a locking assembly 40 being comprised of hinge 26, 28, 29 65, hinge flange insert tongue (27 and 64) and an index assembly element (hinge flange 5, hinge 6, hinge 12, and hinge flange 13).

Figure 14:
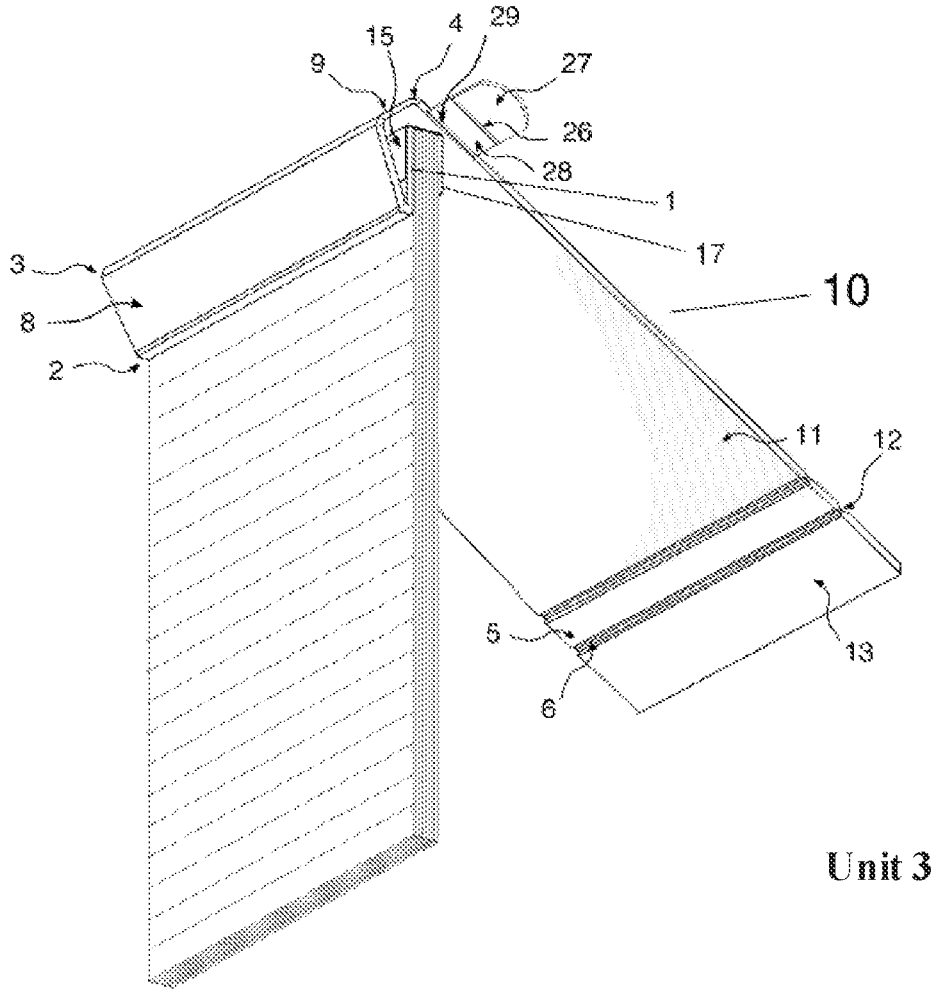
FIG. 14 is a perspective partial reverse fold view of an assembled notepad with hinged baking panel.

Referring to FIG. 14, unit 3 a perspective view of a partially reverse folded/rotated notepad with multi-hinged backing panel 10. In this embodiment the multi-hinged backing panel 10 is rotated up 180 along hinge 2's axis. Hinge flange 8 will then lay flush against hinge flange 1. Hinge flange 9 is rotated 90 degrees along hinge 3's axis. The width of hinge flange 9 approximates the aggregate thickness of the authoring medium 21, hinge flange 1, the binding support 17, and the topper 15. Hinge flange 9 can lay flush against the top most portion of the topper 15. Hinge 11 is then rotated 90 degrees down along hinge 4's axis. When the fold is completed the multi-hinged backing panel 10, specifically the distal end (bottom) of hinge flange 13, will align with the distal end (bottom) of the authoring medium 21. Hinge flange 11, hinge 12, hinge flange 5, hinge 6, and hinge flange 13 can lay flush against the authoring medium 21. The locking assembly 40 illustrated in FIG. 14 comprises hinge 26, hinge flange inserts tongue (27 and 64), hinge flange 28, and hinge 29. The width of the locking assembly 40 approximate the width of hinge flange 1 but can be less than the width of hinge flange 1 as may be required to slot the hinge flange insert tongue (27 and 64) between hinge flange 1 and hinge flange 8. Hinge flange 28 can rotate 90 degrees along hinge 29's axis towards hinge flange 8. The width of hinge flange 28 approximates the aggregate thickness of hinge flange 1, topper 15, binding support 17, and authoring medium 21. The width of hinge flange 28 approximates the aggregate thickness of the topper 15, binding support 17, hinge flange 1, authoring medium 21, and the thickness of any material that may be added between hinge flange 11 and hinge flange 1. Hinge flange 28 will lay flush against the side of authoring medium 21. Hinge tongue 27 can rotate 90 degrees along hinge 26's axis. Hinge flange inserts tongue (27 and 64) can be slotted and nest between hinge flange 8 and hinge flange 1.

Figure 15:
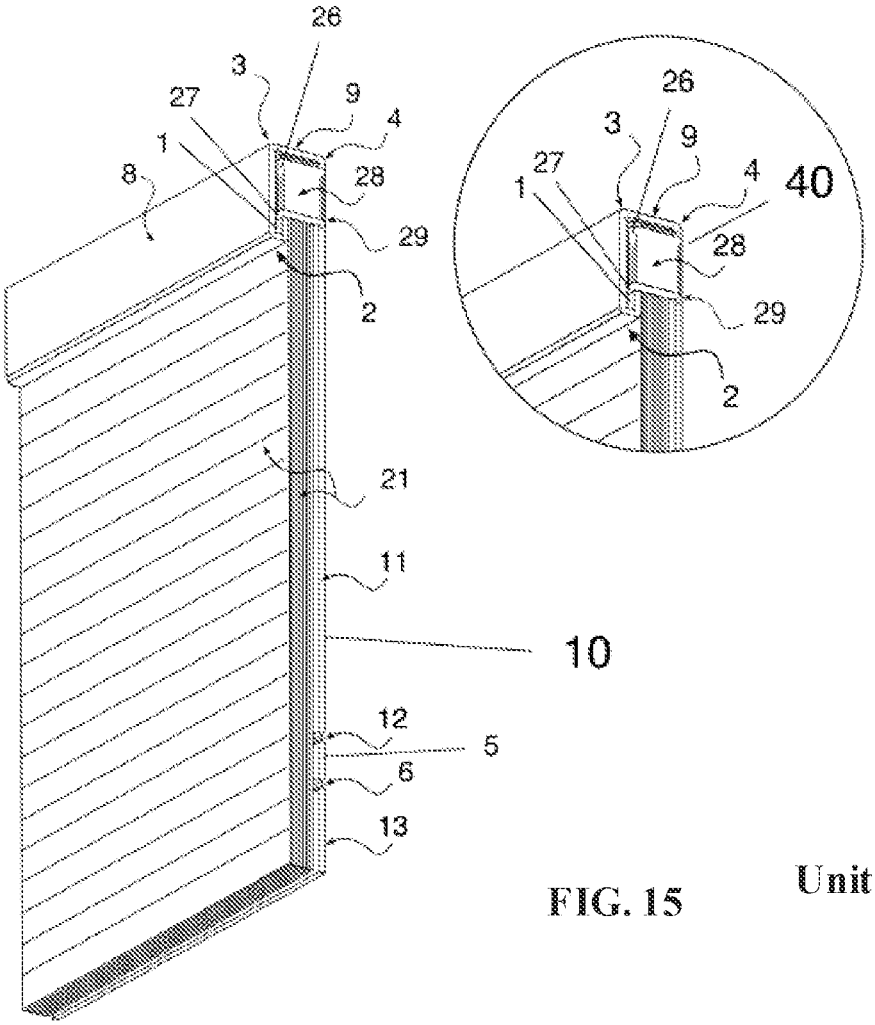
FIG. 15 is a front perspective view of a reversed folded/rotated assembled notepad with multi-hinged backing panel constructed according to an exemplary embodiment.

Referring to FIG. 15, unit 3 is a front perspective view of a reverse folded/rotated notepad with multi-hinged backing panel 10. In this view the reverse folded/rotated notepad assembly exposes the unobserved side of the authoring medium 21. Hinge flange 8, is flush against hinge flange 1. Hinge 2, 3, 4 and hinge flange 8, 9 and 11 are shown folded/rotated as described in the illustration 19. The completed folds are represented here. Hinge flange 11, hinge 12, hinge flange 5, hinge 6, and hinge flange 13 lay flush against the authoring medium 21. The locking assembly 40 is isolated in this illustration. The completed folds are represented here. Hinge flange 28 is rotated 90 degrees along hinge 29's axis towards hinge flange 8. The width of hinge flange 28 approximates the aggregate thickness of the topper 15, the binding support 17 (not shown here), hinge flange 1, authoring medium 21 and the thickness of any material that may be added between hinge flange 11 and hinge flange 1. Hinge flange 28 lay flush against the side of authoring medium 21. Hinge tongue 27 (not shown here) is rotated at 90 degrees along hinge 26's axis. Hinge flange insert tongue 27 and 64 are slotted and nest between hinge flange 8 and hinge flange 1. The distal end (bottom) of hinge flange 13 is generally aligned with the distal end (bottom) of the authoring medium 21.

Exemplary Embodiment 4

Figure 16:
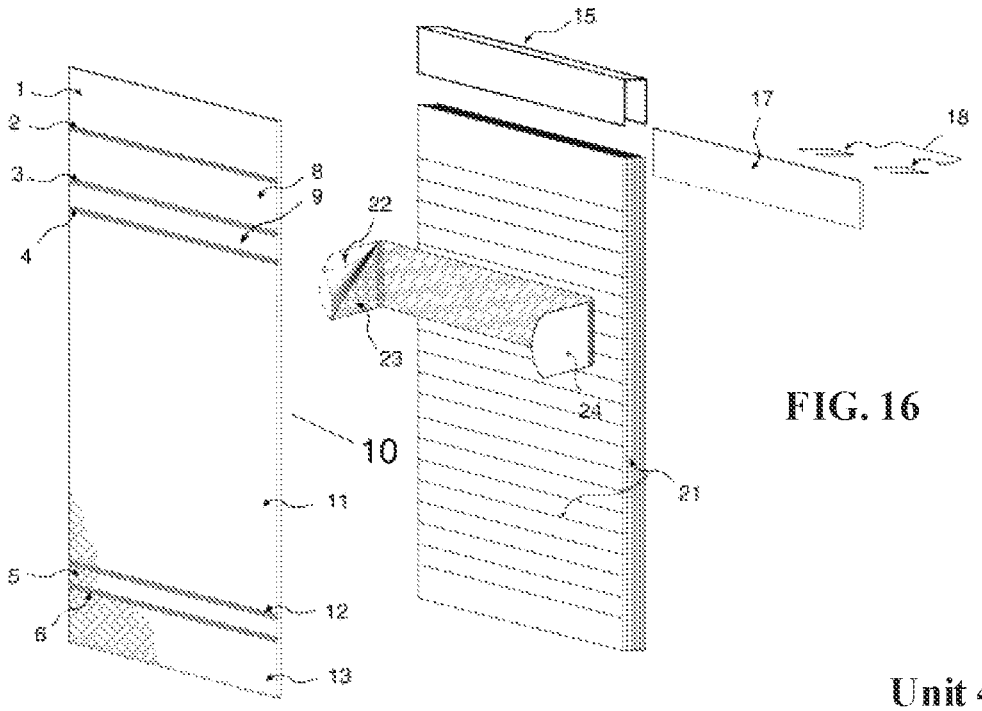
FIG. 16 is an explosive perspective view of the multi-hinged backing panel and notepad constructed according to an exemplary embodiment.

Referring to FIG. 16. Unit 4 is an exploded view of a multi-hinged backing panel 10 notepad. Hinged backing panel 10 is comprised of hinges 2, 3, 4, 12, 6, hinge flanges 1, 8, 9, 11, 5, 13, an adhesive tape strip 24, adhesive 23 on one side, and two removable adhesive tape covers 22 (only one can be seen here) that when removed will expose the adhesive 23. To assemble, adhesive tape strip 24 will attach to the unobserved side of the multi-hinged backing panel 10 directly below hinge 4. The authoring medium 21 is position flush against the multi-hinge backing panel 10 and the adhesive tape strip 24. Binding support 17 is positioned against the authoring medium 21. The group can be held in place by staples 18. It can then be covered with a toper 15.

Figure 17:
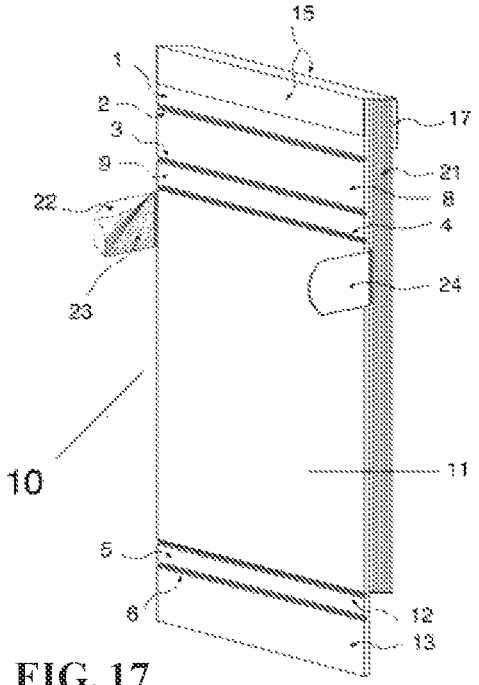
FIGS. 17 and 18 are perspective back and front views thereof an assembled notepad with multi-hinged backing panel.
Figure 18:
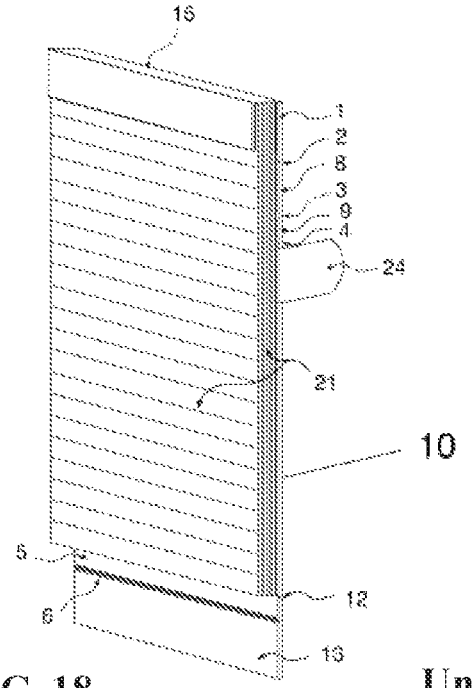

Referring to FIGS. 17 and 18, unit 4, the back and front view of an assembled notepad with multi-hinged backing panel 10. The assembled notepad can be comprised of a binding support 17 connected to authoring medium 21, connected to the multi-hinged backing panel 10. The group is held in place by staples 18 (not shown here). It can them be covered with a topper cover 15. The multi-hinged backing panel 10 is comprised of hinges 2, 3, 4, 12, 6 and hinge flanges 1, 8, 9, 11, 5, and 13. The adhesive strip 24 is centered, affixed to, and positioned on the unobserved side of the multi-hinged backing panel 10 at hinge flange 11. The adhesive tape strip 24 is parallel to and positioned directly below hinge 4. It is covered by the authoring medium 21. FIG. 17 shows the removable adhesive tape cover 22 pulled back to expose adhesive 23. The adhesive tape strip 24 extends out from both sides of hinge flange 11. When the multi-hinged backing panel 10 is reverse folded/rotated, FIGS. 19 and 20, the adhesive tape strip 24 can wrap around the sides of hinge flange 11, binding support 17, authoring medium 21, the topper, 15, hinge flange 1, and hinge flange 8. The adhesive tape strip can extend out on both sides to the length of hinge flange 8 or any distance in-between. The folded/rotated multi-hinged backing panel 10 can be secured in place by removing the adhesive tape cover 22 and pressing the exposed adhesive 23 against hinge 8.

Figure 19:
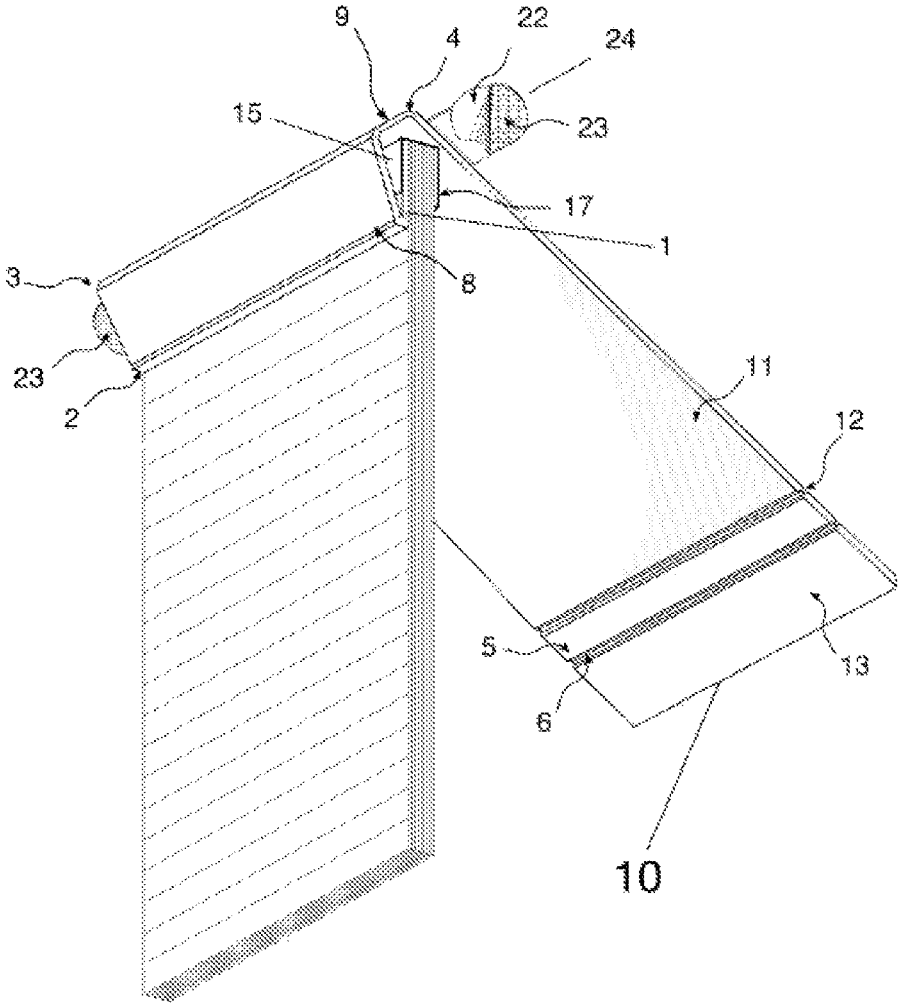
FIG. 19 is a perspective partial reverse fold view of an assembled notepad with hinged baking panel.

Referring to FIG. 19, unit 4, is a perspective view of a partially reverse folded/rotated assembled notepad with multi-hinged backing panel 10. In this embodiment the multi-hinged backing panel 10 is rotated 180 degrees along hinge 2's axis. Hinge flange 8 will then lay flush against hinge flange 1. Hinge flange 9 is rotated 90 degrees along hinge 3's axis. The width of hinge flange 9 approximates the aggregate thickness of the authoring medium 21, hinge flange 1, the binding support 17, and the topper 15. Hinge flange 9 will lay flush against the top most portion of the topper 15. Hinge 11 is then rotated 90 degrees down along hinge 4's axis. Hinge flange 11, hinge 12, hinge flange 5, hinge 6, and hinge flange 13 will lay flush against the authoring medium 21. Then the fold is completed the multi-hinged backing panel 10, specifically the distal end (bottom) of hinge flange 13, will align with the distal end (bottom) of the authoring medium 21. In this view, the adhesive strip 24 is shown positioned on what will be the observed side of hinge flange 11, directly below hinge 4. The adhesive tape strip is no longer covered by authoring medium 21 when reversed folded/rotated. The removable adhesive tape cover 22 is shown pulled back to expose adhesive tape 23.

Figure 20:
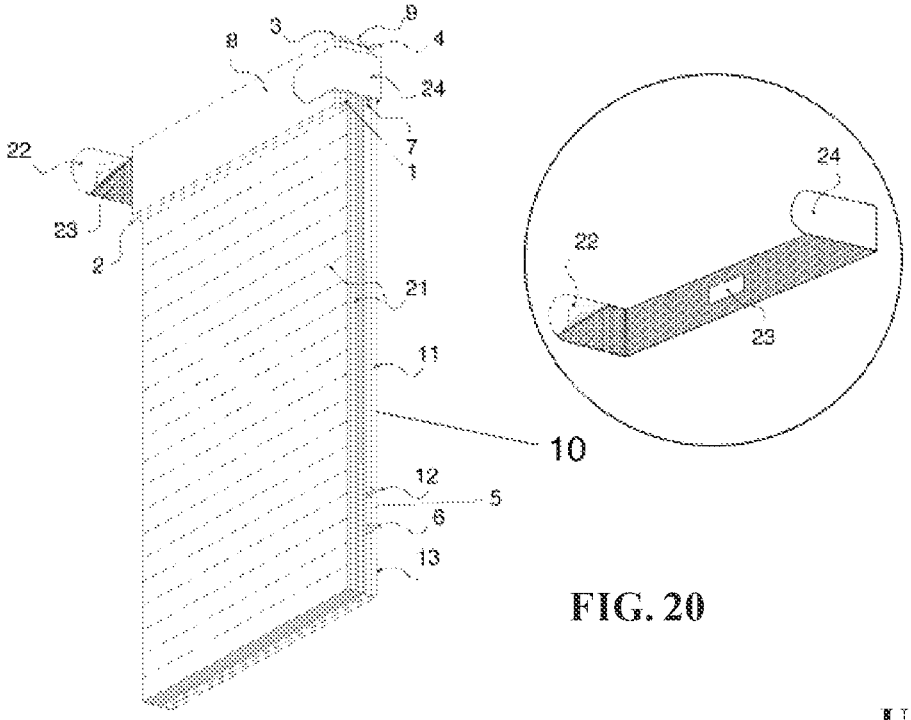
FIG. 20 is a front perspective view of a reversed folded/rotated assembled notepad with multi-hinged backing panel constructed according to an exemplary embodiment.

Referring to FIG. 20 is a front perspective view of a reverse folded/rotated notepad with multi-hinged backing panel 10. In FIG. 20 the reverse folded/rotated notepad exposes the reverse side of the authoring medium surface, authoring medium 21. Hinge flange 8 is flush against hinge flange 1. Hinge 2, 3, 4 and hinge flange 8, 9 and 11 are shown folded/rotated as described in the illustration 26. Hinge flange 11, hinge 12, hinge flange 5, hinge 6, and hinge flange 13 lay flush against the authoring medium 21. The distal end (bottom) of hinge flange 13, align with the distal end (bottom) of the authoring medium 21. Adhesive tape strip 24 is attached to the hinge flange 11. The adhesive tape strip 24 is parallel to and positioned directly below hinge 4. The adhesive tape strip 24 extends out from both sides of hinge flange 11. The adhesive tape strip 24 can wrap around the sides of hinge flange 11, binding support 17, authoring medium 21, the topper, 15, hinge flange 1, and hinge flange 8. The adhesive tape strip can extend out on both sides to the length of hinge flange 8 or any distance in-between. The folded/rotated multi-hinged backing panel 10 can be secured in place by removing the adhesive tape cover 22 and pressing the exposed adhesive 23 against hinge 8.

Exemplary Embodiment 5

Figure 21:
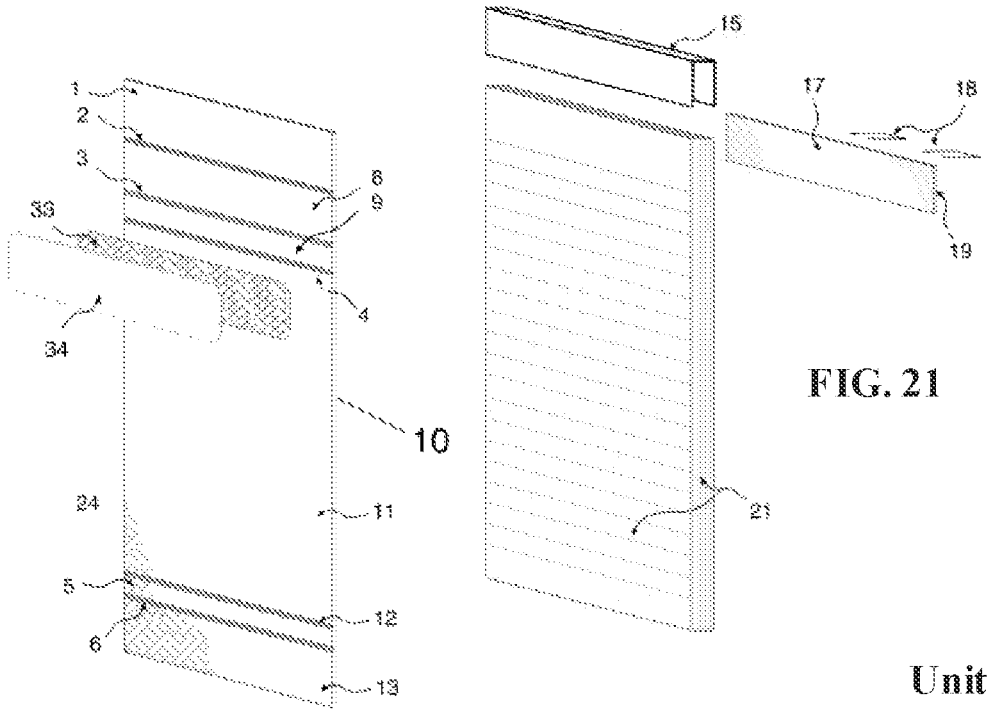
FIG. 21 is an explosive perspective view of the multi-hinged backing panel and notepad constructed according to an exemplary embodiment.

Referring to FIG. 21. Unit 5, is an exploded view of a multi-hinged backing panel 10 notepad showing the hinged backing panel 10 that is comprised of hinges 2, 3, 4, 12, 6 and hinge flanges 1, 8, 9, 11, 5, 13, a double sided adhesive tape strip 19 comprised of adhesive strip 33, adhesive tape cover 34, authoring medium 21, binding support portion 17, a topper 15, and staples 18.

Figure 22:
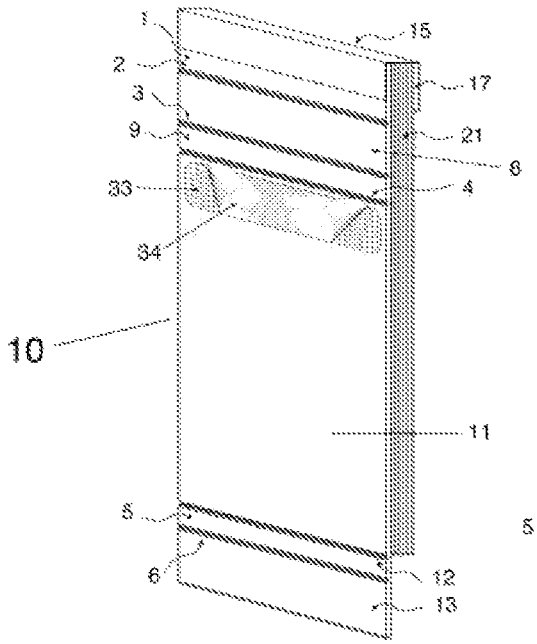
FIGS. 22 and 23 are perspective back and front views thereof an assembled notepad with multi-hinged backing panel constructed according to an exemplary embodiment.
Figure 23:
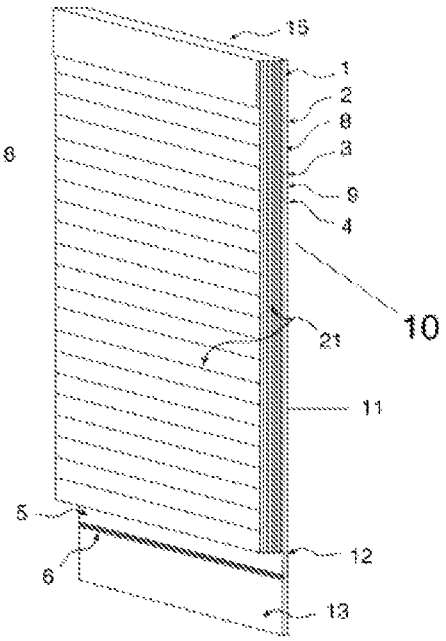

Referring to FIGS. 22 and 23, unit 5 is a back and front view of an assembled notepad being comprised of a binding support 17 connected to authoring medium 21, connected to the multi-hinged backing panel 10. The group is held in place by staples 18 and a topper cover 15. The multi-hinged backing panel 10 is comprised of hinges 2, 3, 4, 12, 6 and hinge flanges 1, 8, 9, 11, 5, and 13. The adhesive tape strip 19 comprised of adhesive strip 33 and adhesive tape cover 34 is affixed to and positioned on the observed side of the multi-hinged backing panel 10, directly below hinge 4. The adhesive tape strip 19 comprises an adhesive tape cover 34 that can be removed to expose adhesive tape 33. When the multi-hinged backing panel 10 is reverse folded/rotated, the adhesive strip 33 can adhere to the topper cover 15 that is over binding support 17.

Figure 24:
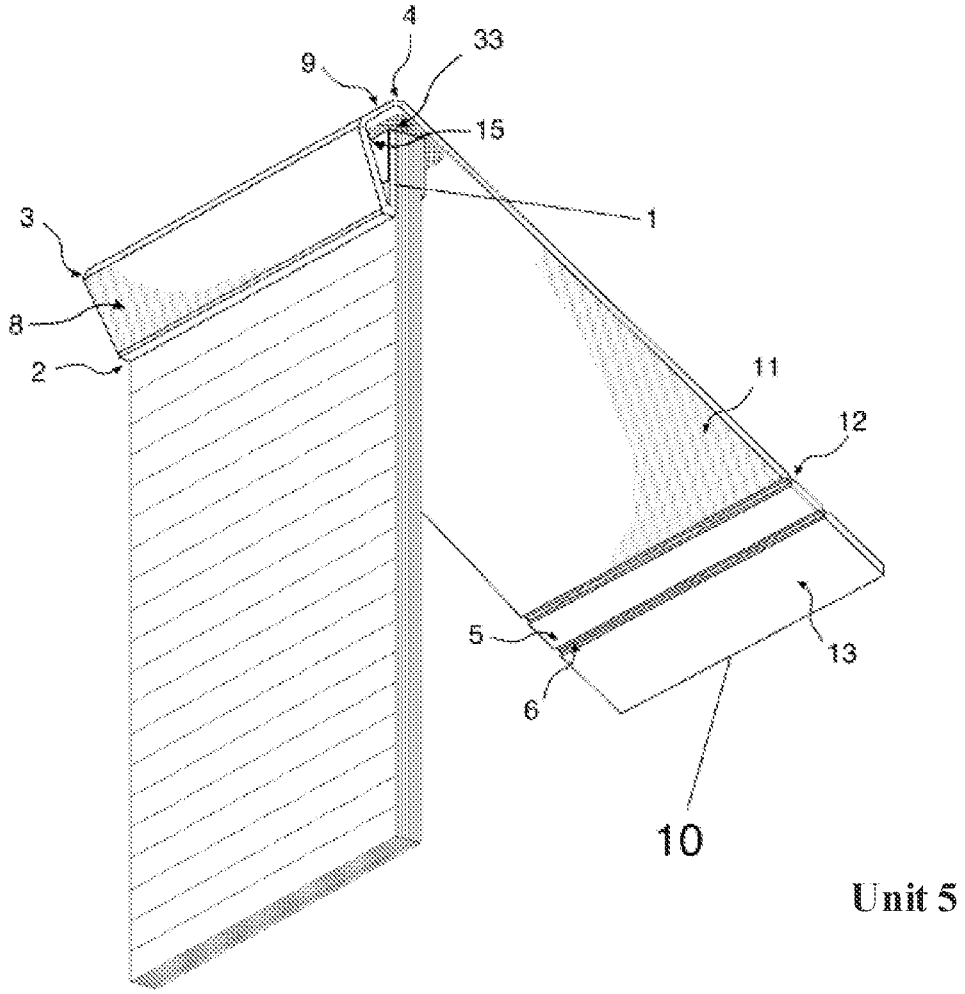
FIG. 24 is a perspective partial reverse fold view of an assembled notepad with hinged baking panel constructed according to an exemplary embodiment.

Referring to FIG. 24, unit 5 is a perspective view of a partially reverse folded/rotated notepad with multi-hinged backing panel 10. In this embodiment the multi-hinged backing panel 10 is rotated up 180 along hinge 2's axis. Hinge flange 8 will then lay flush against hinge flange 1 and topper 15. Hinge flange 9 is rotated 90 degrees along hinge 3's axis. The width of hinge flange 9 approximates the aggregate thickness of the authoring medium 21, hinge flange 1, the binding support 17, and the topper 15. Hinge flange 9 will lay flush against the top most portion of the topper 15. Hinge 11 is then rotated 90 degrees down along hinge 4's axis. Hinge flange 11, hinge 12, hinge flange 5, hinge 6, and hinge flange 13 will lay flush against the authoring medium 21. When the fold is completed the multi-hinged backing panel 10, specifically the distal end (bottom) of hinge flange 13, will align with the distal end (bottom) of the authoring medium 21. In this illustration, the adhesive tape strip has cover 34 removed to expose the adhesive 33. When hinge flange 11 is rotated, the adhesive 33 can adhere to topper 15 and/or binding support 17.

Figure 25:
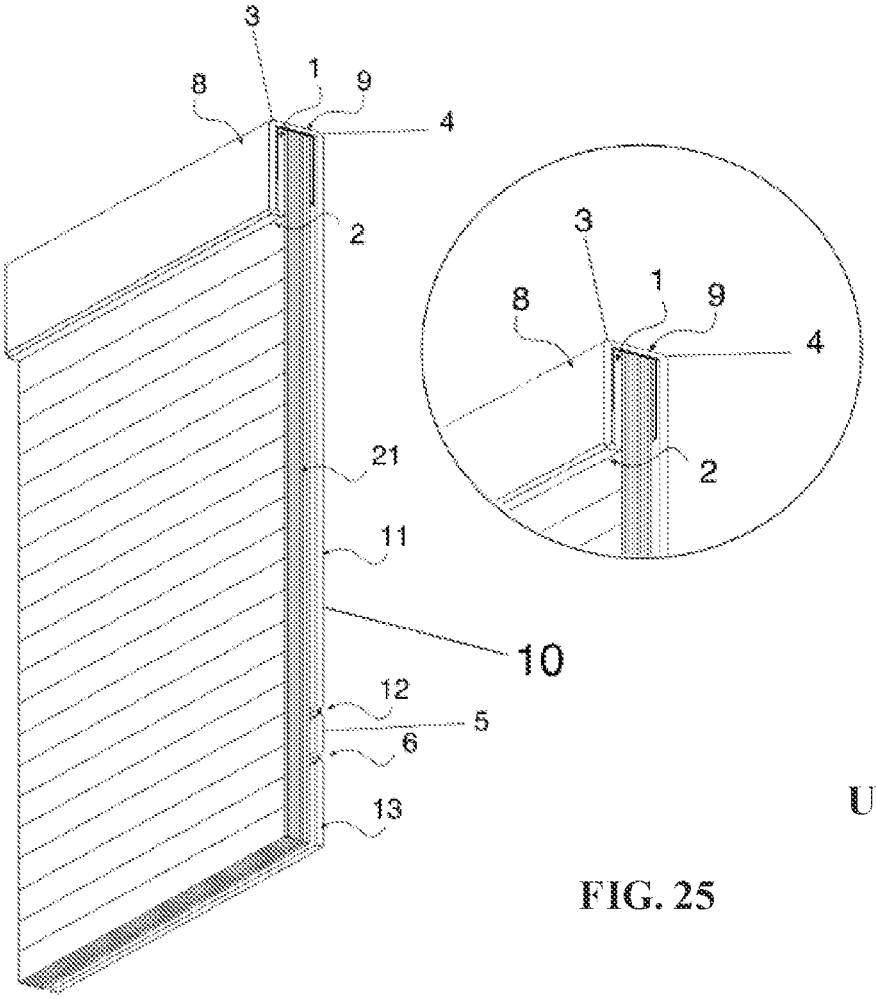
FIG. 25 is a front perspective view of a reversed folded/rotated assembled notepad with multi-hinged backing panel constructed according to an exemplary embodiment.

Referring to FIG. 25 unit 5 is a perspective front view of a reversed folded/rotated notepad with multi-hinge backing panel 10. In this illustration hinge flange 8 was rotated at 90 degrees along hinge 2's axis and lay flush against hinge flange 1. Hinge flange 9 is rotated 90 degrees along hinge 3 axis. The width of hinge flange 9 approximates aggregate thickness of the authoring medium 21, hinge flange 1, topper 15, and support 17. Hinge flange 9 lay flush against this group. Hinge flange 11 is rotated 90 degrees along hinge 4 axis. Hinge flange 11, hinge 12, hinge flange 5, hinge 6, and hinge flange 13 lay flush against the authoring medium 21. In this illustration the adhesive strip cover 34 was removed from the adhesive tape so that adhesive 33 can adhere to the side of topper 15 and/or binding support 17.

Exemplary Embodiment 6

Figure 26:
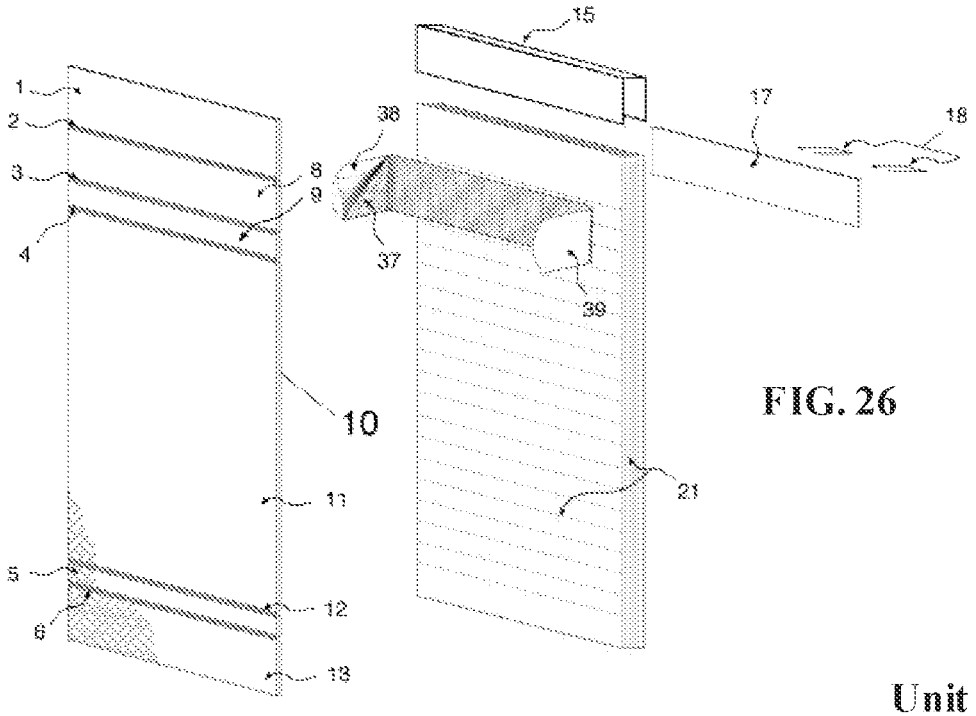
FIG. 26 is an explosive perspective view of the multi-hinged backing panel and notepad constructed according to an exemplary embodiment.

Referring to FIG. 26. Unit 6 is an exploded view of a notepad showing the hinged backing the multi-hinged backing panel 10 being comprised of hinges 2, 3, 4, 12, 6, hinge flanges 1, 8, 9, 11, 5, 13, an adhesive tape strip 20 comprised of adhesive 37, removable adhesive tape cover 38, adhesive tape strip backing 39, authoring medium 21, binding support portion 17, a topper 15, staples 18, and authoring medium 21.

Figure 27:
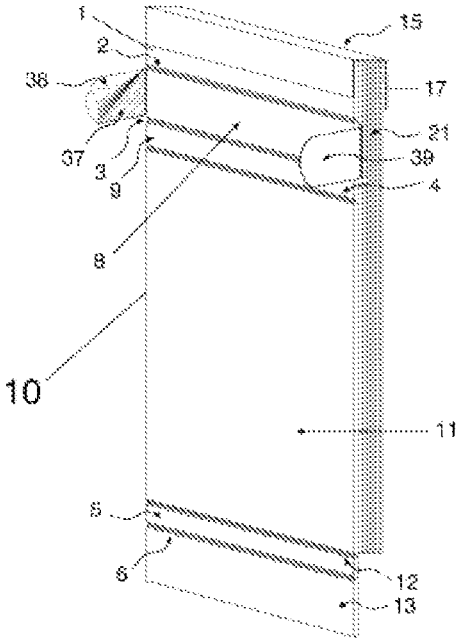
FIGS. 27 and 28 are perspective back and front views thereof an assembled notepad with multi-hinged backing panel constructed according to an exemplary embodiment.
Figure 28:
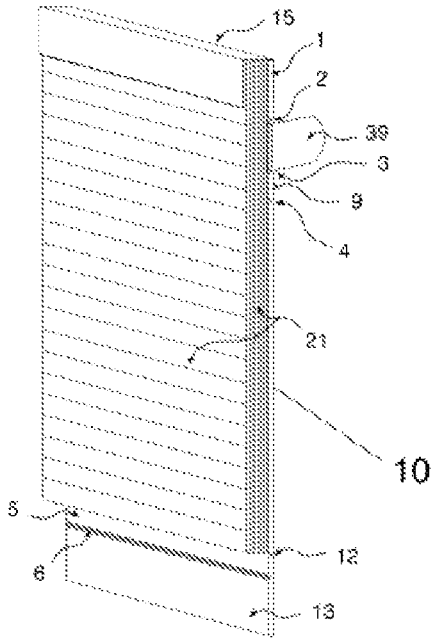

Referring to FIGS. 27 and 28, unit 6. The back and front view of an assembled notepad can comprise a binding support portion 17 that is connected to authoring medium 21. Authoring medium 21 is connected to the multi-hinged backing panel 10 at hinge flange 1. The group is held in place by staples 18 (not shown here) and a topper cover 15. The multi-hinged backing panel 10 is comprised of hinges 2, 3, 4, 12, 6 and hinge flanges 1, 8, 9, 11, 5, and 13. The adhesive tape strip 20, comprised of adhesive strip 37 and adhesive tape cover 38 and adhesive tape backing 39, is affixed to and positioned on the unobserved side of hinge flange 8 directly below hinge 2 and above hinge 3. The adhesive tape strip 20 can have a height that approximates the height of hinge flange 8 or the height of any distance in-between the height of hinge flange 8. The adhesive tape strip 20 comprises an adhesive tape cover 38 that can be removed to expose adhesive tape 37. When the multi-hinged backing panel 10 is reverse folded/rotated, see FIGS. 29, and 30, the adhesive 37 can adhere to hinge flange 11 below hinge 4. This connection can secure the multi-hinged backing panel 10 against the authoring medium 21.

Figure 29:
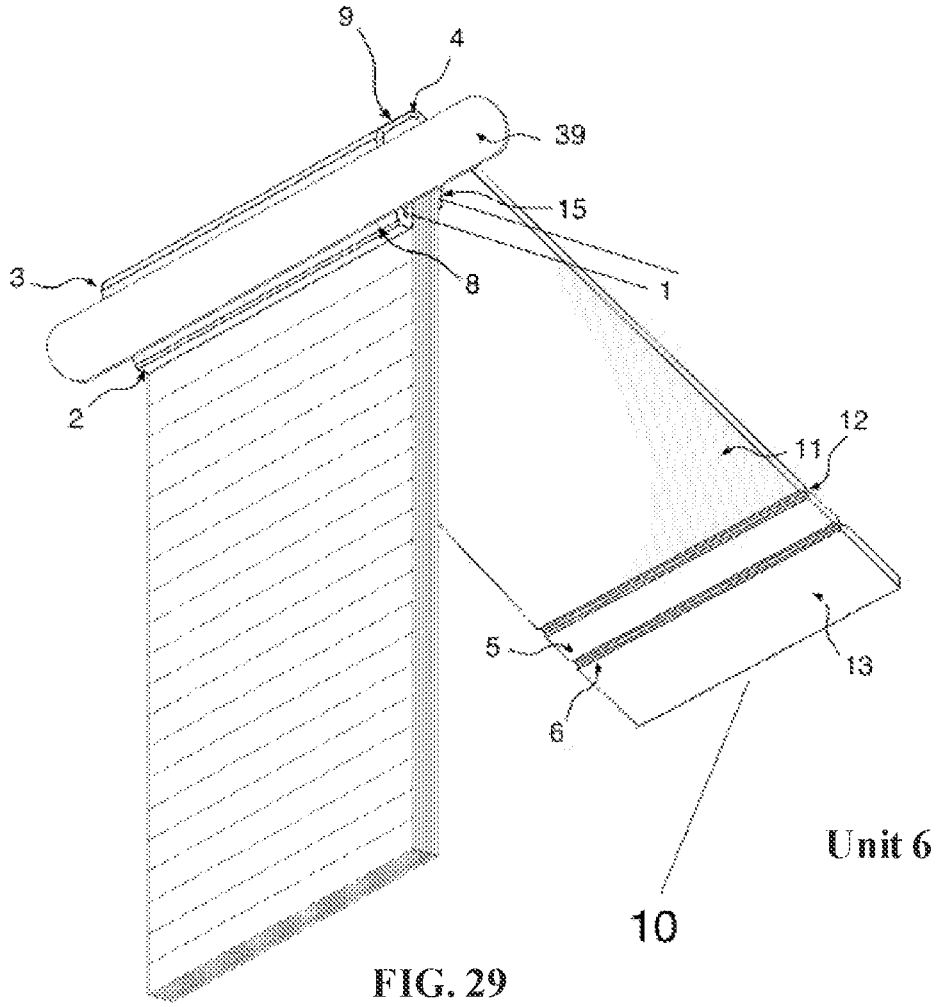
FIG. 29 is a perspective partial reverse fold view of an assembled notepad with hinged baking panel constructed according to an exemplary embodiment.

Referring to FIG. 29, unit 6 is a perspective view of a partially reverse folded/rotated notepad with multi-hinged backing panel 10. In this embodiment the multi-hinged backing panel 10 is rotated up 180 along hinge 2's axis. Hinge flange 8 will then lay flush against hinge flange 1. Hinge flange 9 is rotated 90 degrees along hinge 3's axis. The width of hinge flange 9 approximates the aggregate thickness of authoring medium 21, hinge flange 1, binding support 17, and the topper 15. Hinge flange 9 will lay flush against the top most portion of the topper 15. Hinge 11 is then rotated 90 degrees down along hinge 4's axis. Hinge flange 11, hinge 12, hinge flange 5, hinge 6, and hinge flange 13 will lay flush against the authoring medium 21. When the folds are completed, the multi-hinged backing panel 10, specifically the distal end (bottom) of hinge flange 13, will align with the distal end (bottom) of the authoring medium 21. In this illustration the adhesive tape cover 38 was removed (not shown here) to expose the adhesive 37 (not shown here). When hinge flange 11 rotation is completed, the exposed adhesive 37 can adhere to and hold hinge flange 11, hinge 12, hinge flange 5, hinge 6, and hinge flange 13 flush against the authoring medium 21.

Figure 30:
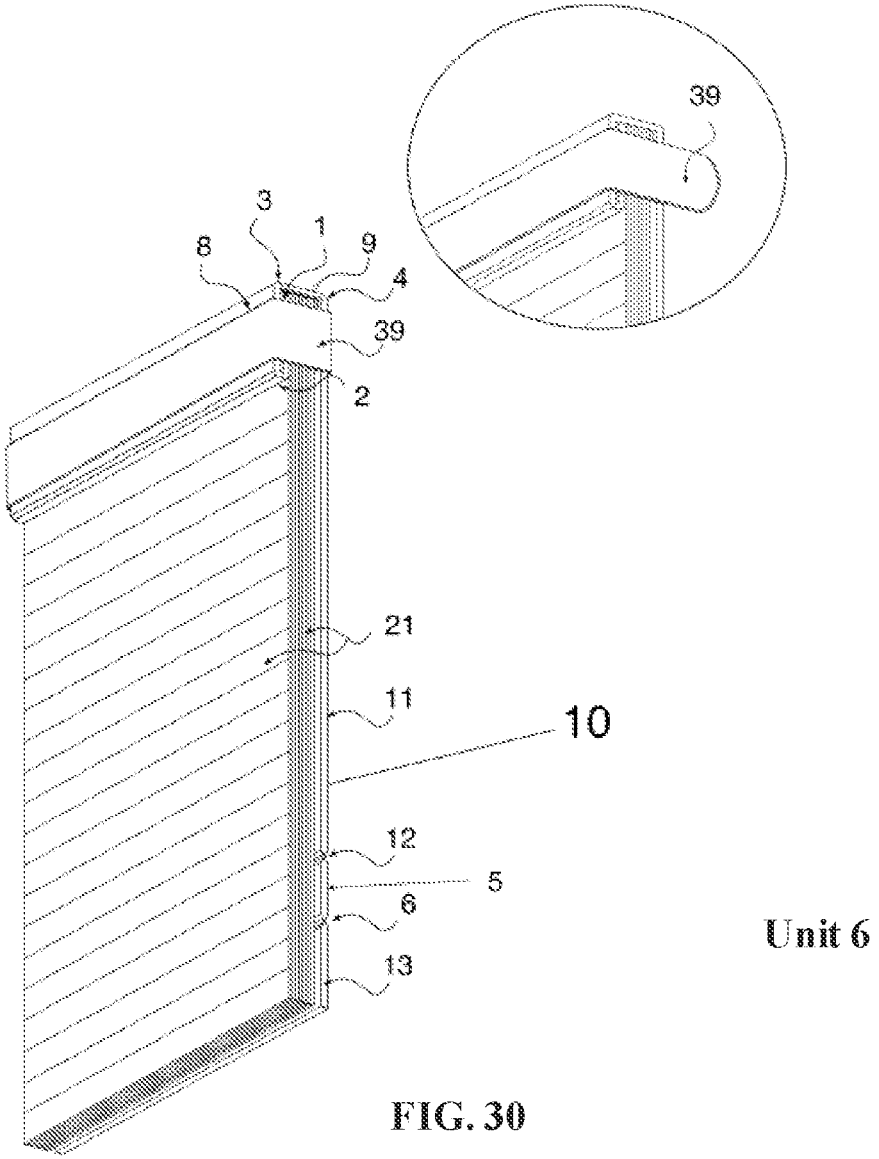
FIG. 30 is a front perspective view of a reversed folded/rotated assembled notepad with multi-hinged backing panel constructed according to an exemplary embodiment.

Referring to FIG. 30, unit 6 is a perspective front view of a reversed folded/rotated notepad with multi-hinge backing panel 10. In this illustration hinge flange 8 is flush against hinge flange 1. Hinge flange 9 is rotated 90 degrees along hinge 3 axis. The width of hinge flange 9 approximates the aggregate thickness of authoring medium 21, hinge flange 1, binding support 17 (not shown here), and topper 15. Hinge flange 9 lay flush against this group. Hinge flange 11 is rotated 90 degrees along hinge 4 axis. Hinge flange 11, hinge 12, hinge flange 5, hinge 6, and hinge flange 13 lay flush against the authoring medium 21. In this illustration the adhesive strip cover 38 (not shown here) was removed from the adhesive tape strip 20. The adhesive strip 39 is wrapped around the notepad. Adhesive 37 (not shown here) is attached to the sides of the notepad assembly and further folded/rotated onto and attached to hinge flange 11 below hinge 4. The width of adhesive tape strip 20 can approximate the width of hinge flange 8 or any width in-between.

Exemplary Embodiment 7

Figure 31:
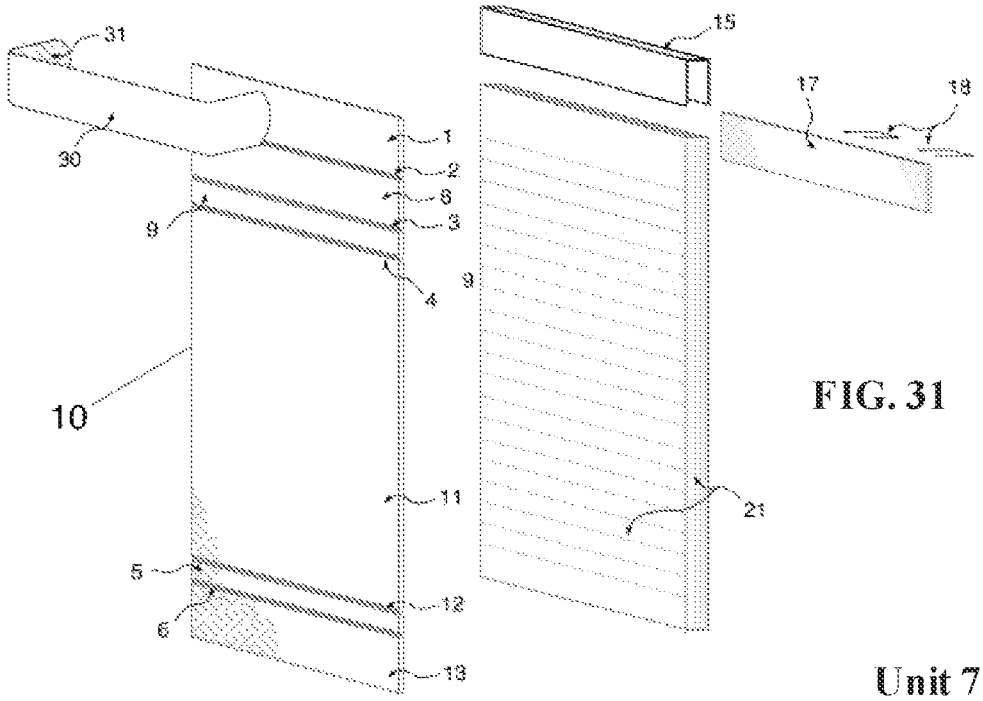
FIG. 31 is an explosive perspective view of the multi-hinged backing panel and notepad constructed according to an exemplary embodiment.

Referring to FIG. 31. Unit 7 is an exploded view of a multi-hinged backing panel 10 notepad showing the hinged backing panel 10 that is comprised of hinges 2, 3, 4, 12, 6 and hinge flanges 1, 8, 9, 11, 5, 13, an adhesive tape strip 25 being comprised of adhesive 31 (not shown here), adhesive backing 30, adhesive tape cover 32 (not shown here), authoring medium 21, binding support portion 17, a topper 15, and staples 18.

Figure 32:
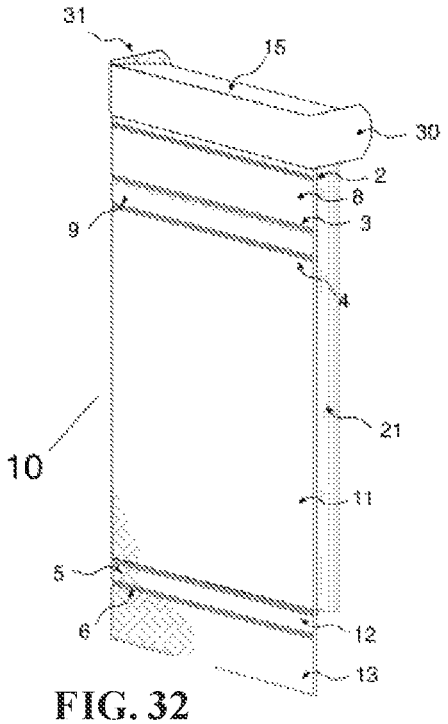
FIGS. 32 and 33 are perspective back and front views thereof an assembled notepad with multi-hinged backing panel constructed according to an exemplary embodiment.
Figure 33:
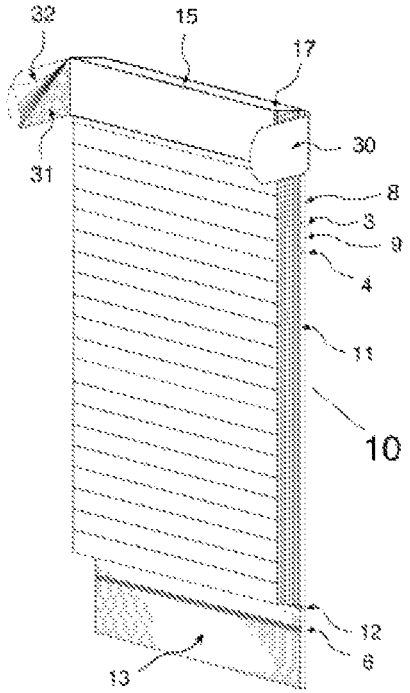

Referring to FIGS. 32 and 33, unit 7. The back and front view of an assembled notepad, comprise a binding support portion 17 that is connected to authoring medium 21. Authoring medium 21 is connected to the multi-hinged backing panel 10 at hinge flange 1. The group is held in place by staples 18 (not shown here) and a topper cover 15. The multi-hinged backing panel 10 is comprised of hinges 2, 3, 4, 12, 6 and hinge flanges 1, 8, 9, 11, 5, and 13. The adhesive tape strip 25, being comprised of adhesive 31, adhesive backing 30, and adhesive tape cover 32, is affixed to and positioned on the observed side of hinge flange 1 above hinge 2. The adhesive tape strip 25 can have a height that is equal to the height of hinge flange 1 or the height of any distance that is less than the height of hinge flange 1. The adhesive tape strip 25 comprises an adhesive tape cover 32 that can be removed to expose adhesive tape 31.

Figure 34:
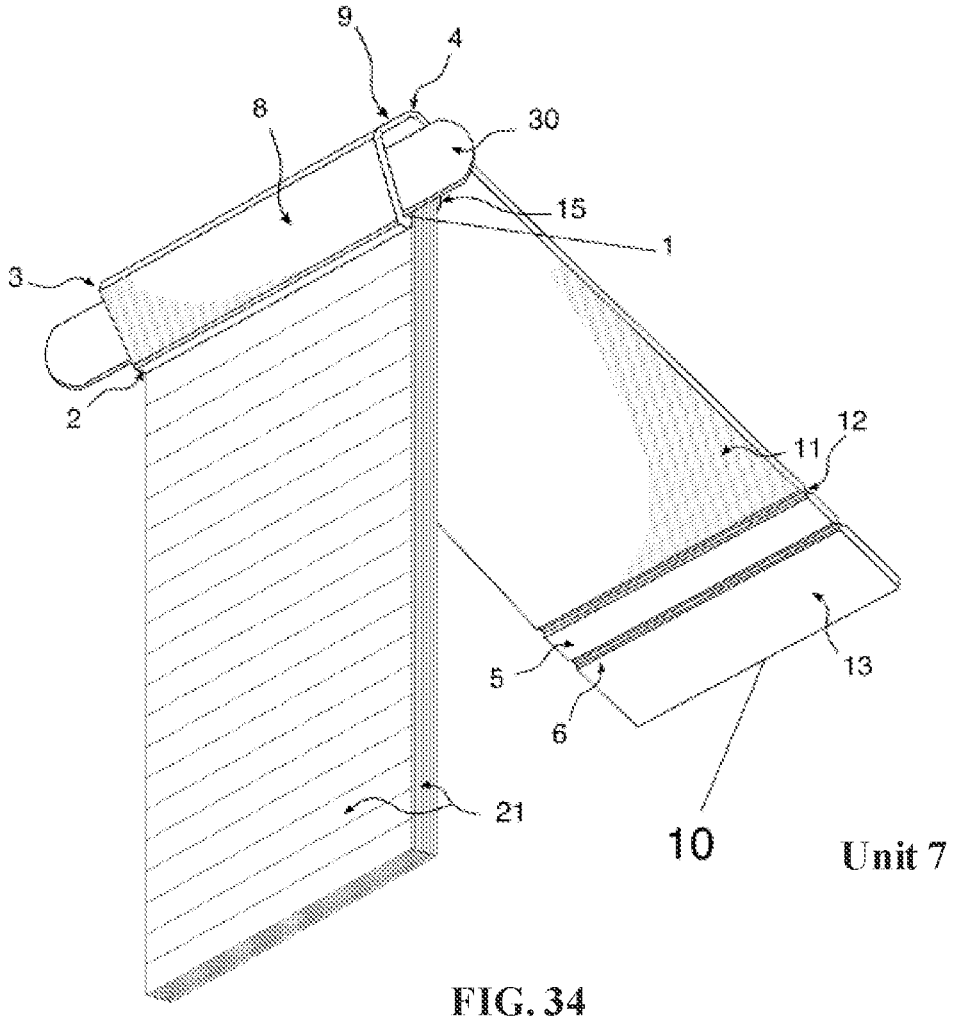
FIG. 34 is a perspective partial reverse fold view of an assembled notepad with hinged baking panel constructed according to an exemplary embodiment.

Referring to FIG. 34, unit 7 is a perspective view of a partially reverse folded/rotated notepad with multi-hinged backing panel 10. In this embodiment the multi-hinged backing panel 10 is rotated up 180 along hinge 2's axis. Hinge flange 8 and the adhesive tape strip 25 will then lay flush against hinge flange 1. The adhesive tape backing 30 can be seen wedged between hinge flange 1 and hinge flange 8. Hinge flange 9 can rotate 90 degrees along hinge 3's axis. The width of hinge flange 9 approximates the aggregate thickness of authoring medium 21, hinge flange 1, binding support 17, and the topper 15. Hinge flange 9 will lay flush against the top most portion of the topper 15. Hinge 11 is then rotated 90 degrees down along hinge 4's axis. Hinge flange 11, hinge 12, hinge flange 5, hinge 6, and hinge flange 13 will lay flush against the authoring medium 21. When the rotations are completed, hinge flange 13, will align with the distal end (bottom) of the authoring medium 21.

Figure 35:
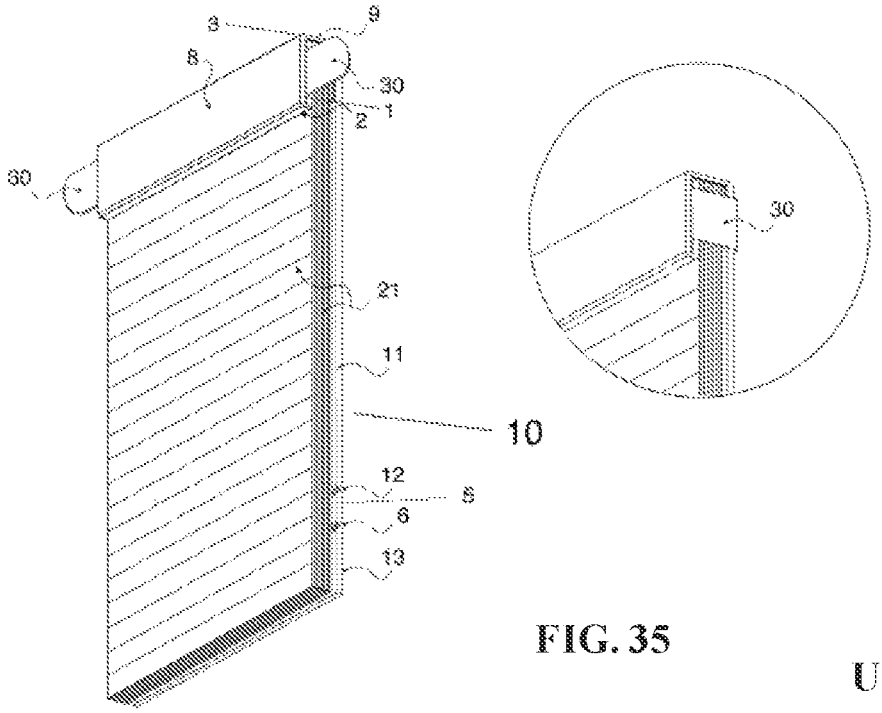
FIG. 35 is a front perspective view of a reversed folded/rotated assembled notepad with multi-hinged backing panel constructed according to an exemplary embodiment.

Referring to FIG. 35, Unit 7 is a perspective front view of a reversed folded/rotated notepad with multi-hinge backing panel 10. In this illustration hinge flange 8 and the adhesive tape strip 25 are flush against hinge flange 1. Hinge flange 9 is rotated 90 degrees along hinge 3 axis. The width of hinge flange 9 approximates the aggregate thickness of authoring medium 21, hinge flange 1, binding support 17, and topper 15. Hinge flange 9 lay flush against this group. Hinge flange 11 is rotated 90 degrees along hinge 4 axis. Hinge flange 11, hinge 12, hinge flange 5, hinge 6, and hinge flange 13 lay flush against the authoring medium 21. In this illustration the adhesive tape strip 25 comprises an adhesive tape cover 32 removed (not shown here) to expose the adhesive 31 (not shown here), and adhesive backing 30. The adhesive tape strip 25 can be folded/rotated across hinge 1, authoring medium 21, binding support 17, topper 15 and the face of hinge flange 11 where the exposed adhesive 31 (not shown here) adhere to and hold hinge flange 11 against authoring medium 21

Exemplary Embodiment 8

Figure 36:
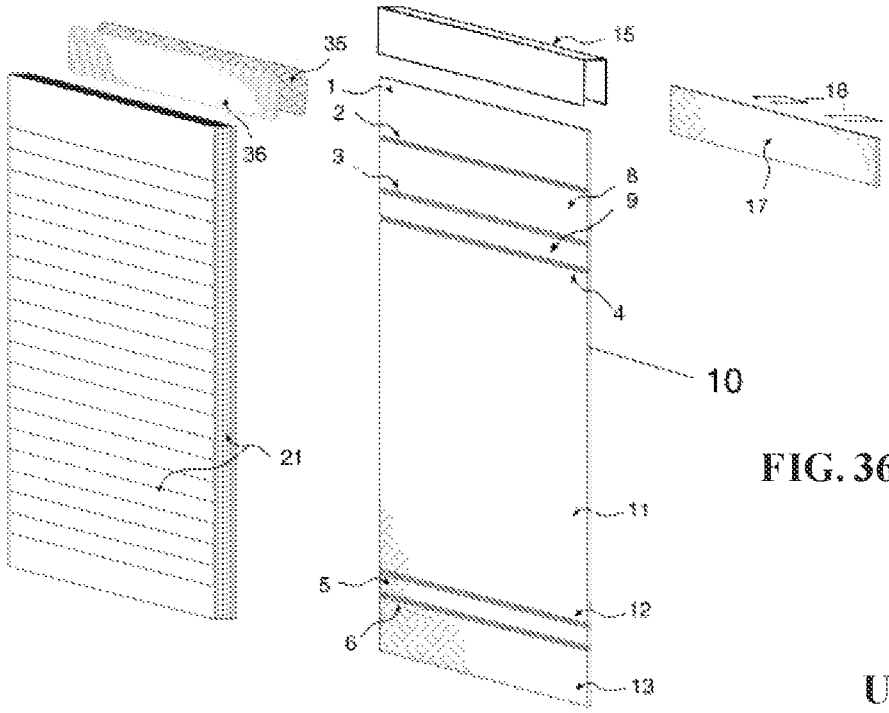
FIG. 36 is an explosive perspective view of the multi-hinged backing panel and notepad constructed according to an exemplary embodiment.

Referring to FIG. 36. Unit 8 is an exploded view of a multi-hinged backing panel 10 notepad showing hinged backing panel 10 being comprised of hinges 2, 3, 4, 12, 6 and hinge flanges 1, 8, 9, 11, 5, 13, an adhesive tape strip 49 being comprised of adhesive strip 35, adhesive tape cover 36, authoring medium 21, binding support portion 17, a topper 15, staples 18, and adhesive tape strip 52 being comprised of and adhesive 51 and a smooth adhesive backing 50.

Figure 37:
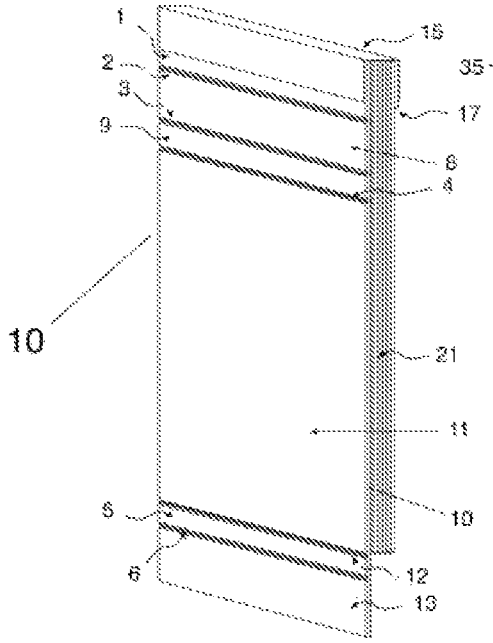
FIGS. 37 and 38 are perspective back and front views thereof an assembled notepad with multi-hinged backing panel.
Figure 38:
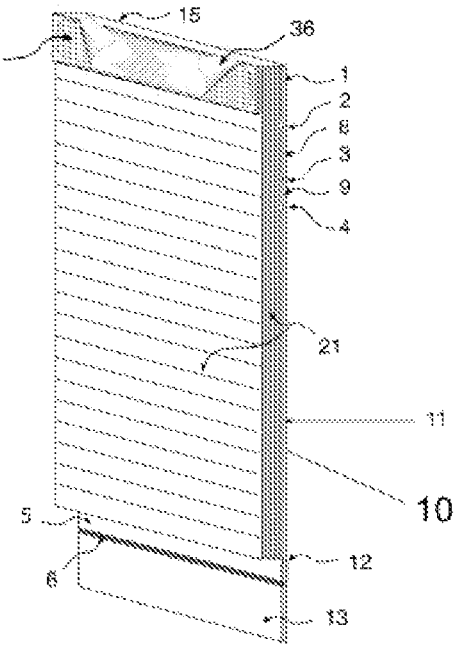

Referring to FIGS. 37 and 38, unit 8. The back view FIG. 37 is a perspective back view and front view FIG. 38 of an assembled notepad being comprised of a binding support portion 17 connected to authoring medium 21, connected to the multi-hinged backing panel 10. The group is held in place by staples 18 (not shown here) and a topper cover 15. The multi-hinged backing panel 10 is comprised of hinges 2, 3, 4, 12, 6 and hinge flanges 1, 8, 9, 11, 5, and 13. The adhesive tape strip 49, being comprised of adhesive 35 (not shown here) and adhesive tape cover 36 (not shown here), is affixed to the topper on the binding support 17 side of the notepad. IN this illustration the adhesive tape cover 36 was removed to expose adhesive tape 35. When the notepad is reverse folded/rotated, adhesive 35 can adhere to hinge flange 11. Adhesive tape strip 52 can be positioned below hinge 4 and can have, but is not required, a smooth cover to facilitate repositioning of adhesive 35.

Figure 39:
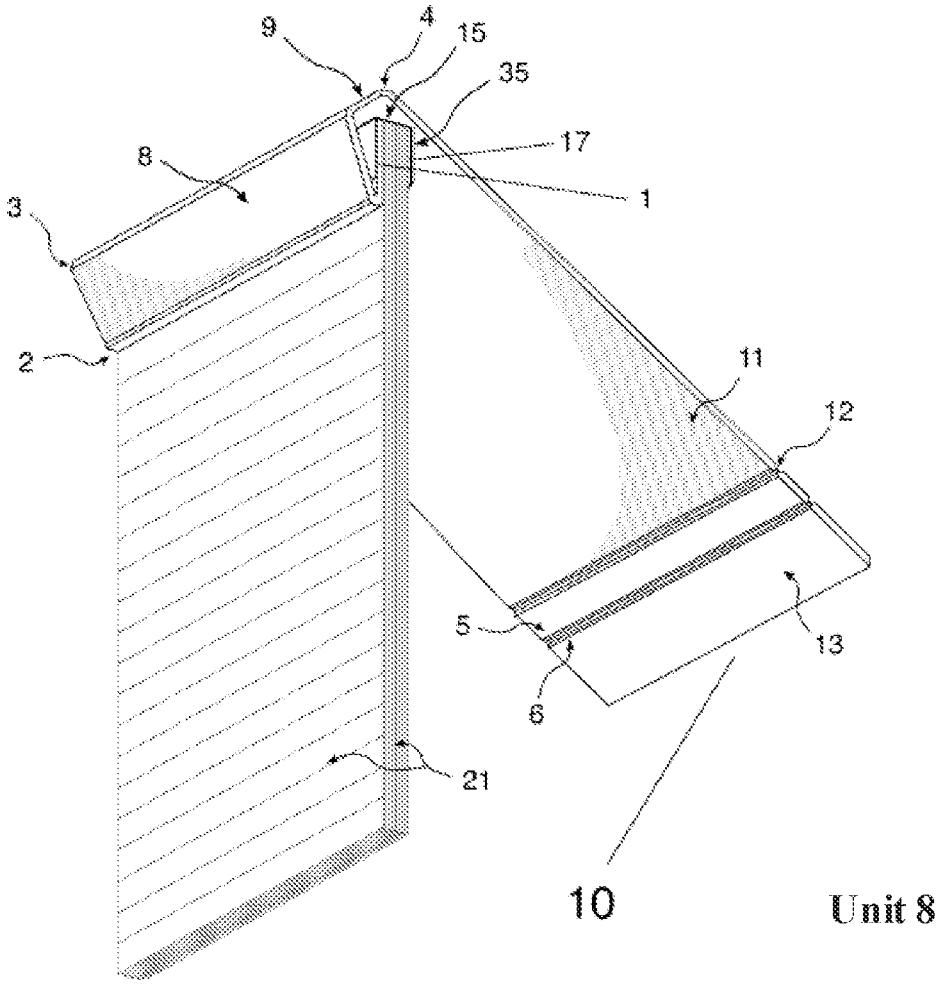
FIG. 39 is a perspective partial reverse fold view of an assembled notepad with hinged baking panel constructed according to an exemplary embodiment.

Referring to FIG. 39, unit 8 is a perspective view of a partially reverse folded/rotated notepad with multi-hinged backing panel 10. In this embodiment the multi-hinged backing panel 10 is rotated up 180 along hinge 2's axis. Hinge flange 8 will then lay flush against hinge flange 1. Hinge flange 8 will be held to topper 15 and hinge flange 1 by adhesive 35 (not shown here). Hinge flange 9 is rotated 90 degrees along hinge 3's axis. The width of hinge flange 9 approximates the aggregate thickness of the authoring medium 21, hinge flange 1, the binding support 17, adhesive tape strip 49, and the topper 15. Hinge flange 9 will lay flush against the top most portion of the topper 15. Hinge 11 is then rotated 90 degrees down along hinge 4's axis. Hinge flange 11, hinge 12, hinge flange 5, hinge 6, and hinge flange 13 will lay flush against the authoring medium 21. When the rotations are completed the multi-hinged backing panel 10, specifically the distal end (bottom) of hinge flange 13, will align with the distal end (bottom) of the authoring medium 21. In this illustration the adhesive tape strip 49 being comprised of an adhesive tape cover 34 (not shown here), was removed to expose adhesive 35 (not shown here). When the assembled notepad multi-hinged backing is reverse rotated/folded the upper end of hinge flange 11, directly below hinge 4, will adhere to adhesive 35. It is desirable to have a smooth adhesive tape backing 50 positioned at the upper portion of hinge 11 to allow adhesive 35 to be repositionable if desired.

Figure 40:
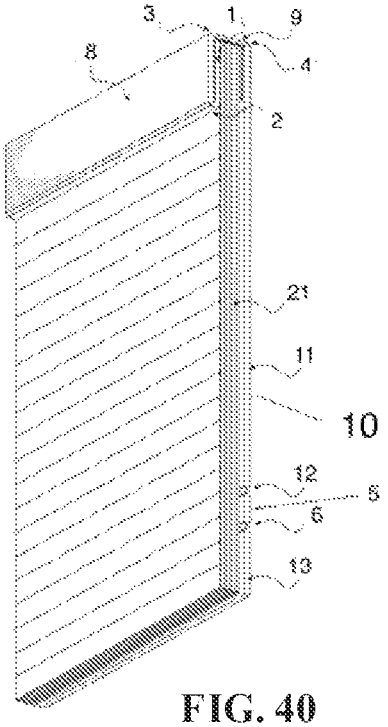
FIG. 40 is a front perspective view of a reversed folded/rotated assembled notepad with multi-hinged backing panel constructed according to an exemplary embodiment.
Figure 40A:
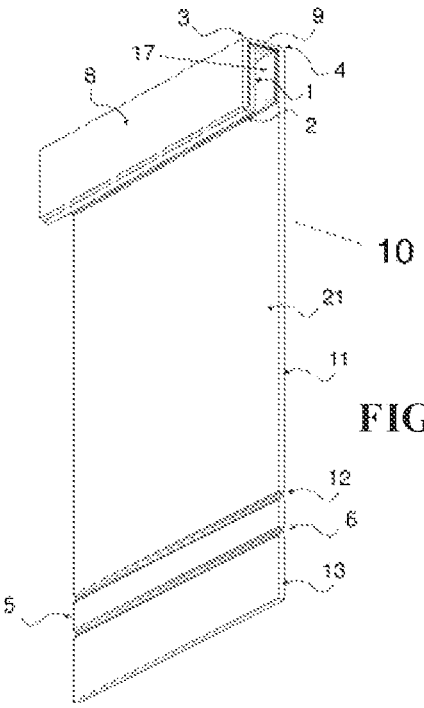
FIG. 40A illustrates the reverse folded/rotated multi-hinged backing panel without the authoring medium.

Referring to FIGS. 40 and 40A, Unit 8 is a perspective front view of a reversed folded/rotated notepad with multi-hinge backing panel 10. In this illustration the adhesive 35 (not shown here) adheres hinge flange 11 to topper 15. Hinge flange 9 is shown rotated 90 degrees along hinge 3's axis. The width of hinge flange 9 approximates aggregate thickness of the authoring medium 21, hinge flange 1, topper 15, binding support 17, adhesive tape strip 49 (not show here), and adhesive tape strip 52 (not shown here). Hinge flange 9 lay flush against the tops of this group. Hinge flange 11 is rotated 90 degrees along hinge 4's axis. Hinge flange 11, hinge 12, hinge flange 5, hinge 6, and hinge flange 13 lay flush against the authoring medium 21. FIG. 40A illustrates the reverse folded/rotated multi-hinged backing panel 10 without the authoring medium 21.

Exemplary Embodiment 9

Figure 41:
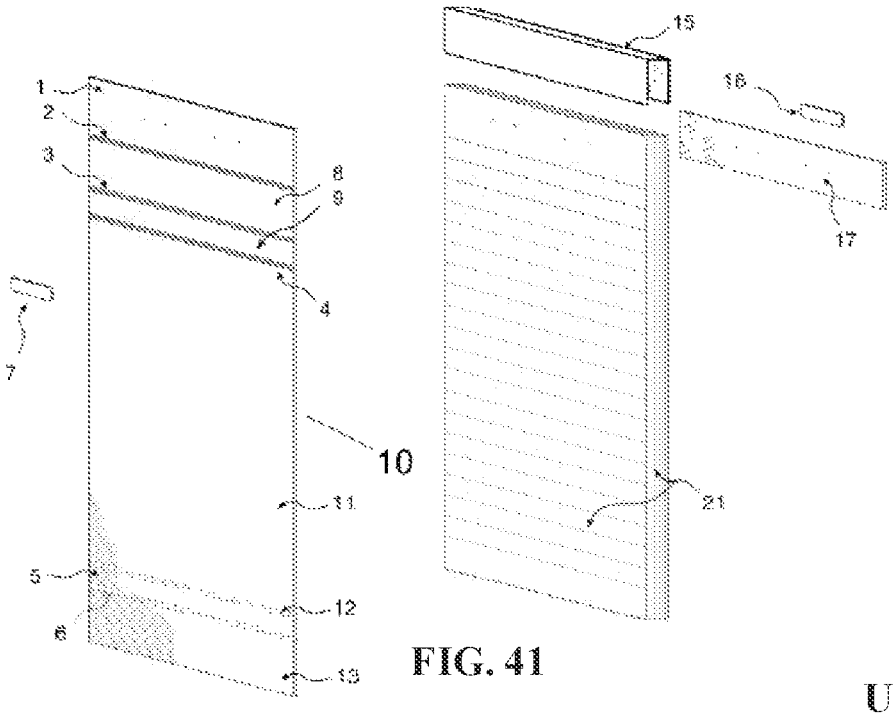
FIG. 41 is an explosive perspective view of the multi-hinged backing panel and notepad constructed according to an exemplary embodiment.

Referring to FIG. 41, unit 9 is an exploded view of a multi-hinged backing panel 10 notepad showing the hinged backing panel 10 that is comprised of hinges 2, 3, 4, 12, 6, hinge flanges 1, 8, 9, 11, 5, 13, magnet 7, magnet/ferromagnetic metal plate 16, authoring medium 21, binding support portion 17, and topper 15.

Figure 42:
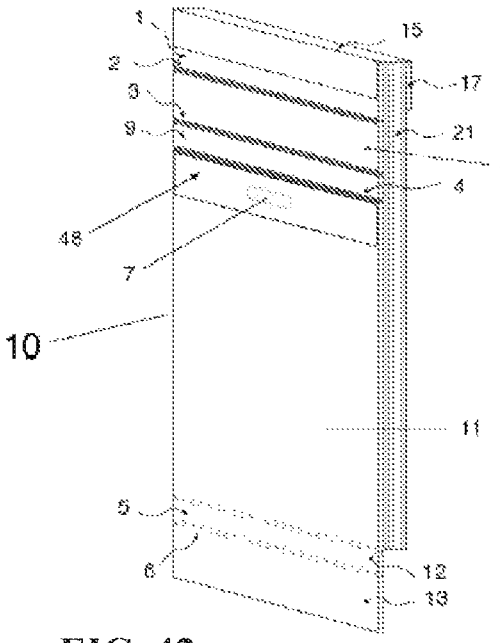
FIGS. 42 and 43 are perspective back and front views thereof an assembled notepad with multi-hinged backing panel constructed according to an exemplary embodiment of the present invention.
Figure 43:
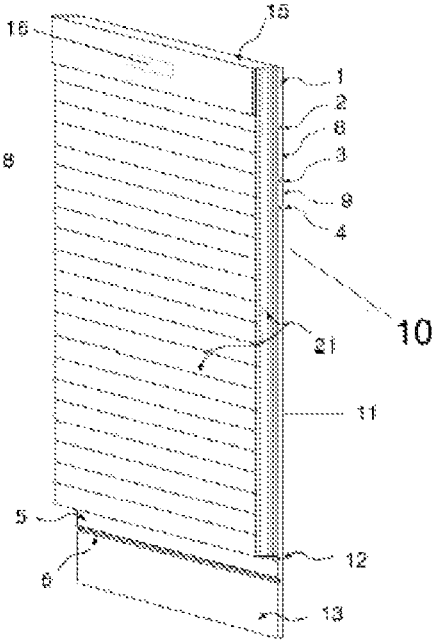

Referring to FIGS. 42 and 43, unit 9. The back and front view of an assembled notepad can comprise a binding support 17 connected to authoring medium 21, connected to the multi-hinged backing panel 10. The group is held in place by staples 18 (not shown here) and a topper cover 15. The multi-hinged backing panel 10 is comprised of hinges 2, 3, 4, 12, 6 and hinge flanges 1, 8, 9, 11, 5, and 13. In this embodiment, FIG. 42 magnet 7 can be affixed to the observed side of hinge flange 11 below hinge 4. Magnet 7 is positioned at a distance that approximates the placement of the magnet/ferromagnetic metal plates 16, FIG. 43, to which magnet 7 will attach when the multi-hinged backing panel is rotated to expose the unobserved side of the authoring medium. The magnet/ferromagnetic plate 16 is generally centered on binding support 17. In this embodiment magnet 7 can be covered over with adhesive 48 and magnet/ferromagnetic metal plate 16 can be covered with topper 15. When the hinged backing panel 10 is reverse folded/rotated, magnet 7 and magnet/ferromagnetic metal plates 16 will attach together thereby holding hinge flange 11 against support 17.

Referring to FIG. 44, unit 9 is a perspective view of a partially reverse folded/rotated notepad with multi-hinged backing panel 10. In this embodiment the multi-hinged backing panel 10 is rotated up 180 along hinge 2's axis. Hinge flange 8 will then lay flush against hinge flange 1 and topper 15. Hinge flange 9 is rotated 90 degrees along hinge 3's axis. The width of hinge flange 9 approximates the aggregate thickness of the authoring medium 21, hinge flange 1, the binding support 17, and the topper 15. Hinge flange 9 will lay flush against the top most portion of the topper 15. Hinge 11 is then rotated 90 degrees down along hinge 4's axis. Hinge flange 11, hinge 12, hinge flange 5, hinge 6, and hinge flange 13 will lay flush against the authoring medium 21. When the fold is completed the multi-hinged backing panel 10, specifically the distal end (bottom) of hinge flange 13, will align with the distal end (bottom) of the authoring medium 21. In this illustration magnet 7 and magnet/ferromagnetic metal plate 16 (not shown here) will connect when the multi-hinged backing panel is rotated to expose the unobserved authoring medium. The connection of magnet 7 and magnet/ferromagnetic metal plate 16 can hold the hinge flange 11, hinge flange 13, hinges, hinge 5, hinge 6, and hinge 12 securely against authoring medium 21.

Referring to FIG. 45, unit 9 is a perspective front view of a reversed folded/rotated notepad with multi-hinge backing panel 10. In this illustration hinge flange 8 was rotated at 90 degrees along hinge 2's axis and lay flush against hinge flange 1. Hinge flange 9 is rotated 90 degrees along hinge 3 axis. The width of hinge flange 9 approximates aggregate thickness of the authoring medium 21, hinge flange 1, topper 15, and support 17. Hinge flange 9 lay flush against this group. Hinge flange 11 is rotated 90 degrees along hinge 4 axis. Hinge flange 11, hinge 12, hinge flange 5, hinge 6, and hinge flange 13 lay flush against the authoring medium 21. Magnet 7 and magnet/ferromagnetic metal plate 16 (not shown here) will connect when the multi-hinged backing panel is rotated to expose the unobserved authoring medium.

While the exemplary embodiments illustrated in the foregoing drawings include at least nine different multi-hinged backings hinge mechanisms, other hinge mechanisms are also possible, such as tape strip overlay hinges (e.g., tape strips that connect hinge flanges). Binding sets can comprise a backing panel such as a multi-hinged panel base portion, a binding support, a topper cover, index assembly element, sheets of authoring medium bound into one or more groups, or any number of other configurations or set groupings. In certain exemplary embodiments, the binding unit can create a substantially flat profile and flush binding, similar in appearance to a notepad's profile prior to folding, but with configurable (rotatable) features illustrated in the above exemplary embodiments. Exemplary embodiments can be formed from any number of sizes, materials, shapes, dimensions, and/or thicknesses (e.g., the authoring medium can be standard sizes, letter, legal, A4, etc.)

Any and/or all of the references specifically identified in the detailed description section of the present application are expressly incorporated herein in their entirety by reference thereto. The term "notepad" as used herein should generally be understood to refer to any system that uses a backing support that is connected to authoring medium e.g., writing pad, sketch pad, drawing pad, etc. The term "approximate" and "approximately," as used herein, should generally be understood to refer to both the corresponding number and a range of numbers. Moreover, all numerical ranges herein should be understood to include each whole integer within the range.

The rotation and folding of hinge 41, hinge flange 42, hinge 43, and hinge flange 44 can be applied to all embodiments that have these elements included. Such elements, regardless the embodiment, will have the same functionality (e.g., hinge 43 can rotated 90 degrees along hinge 41's axis. Hinge flange 43 approximates the thickness of authoring medium 21, and hinge flange 44 can rotates 90 degrees along hinge 42's axis. Hinge flange 1 and hinge flange 44 can connect the authoring medium 21 to the multi-hinge backing panel 10 with an adhesive 46 or staples 18 . . . ). Configurations and mechanics for hinge flange 1, hinge 2, hinge flange 8 hinge 3, hinge flange 9, hinge 4, hinge flange 11, hinge 12, hinge flange 5, hinge 6, and hinge flange 13 can have the same functionality, but can differ depending on the rotation requirements, for all embodiments.

While illustrative embodiments are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present document.

From the foregoing, it will be appreciated that specific embodiments have been described herein for purposes of illustration, but that various modifications may be made without deviating from the scope of the invention. Accordingly, this document is not limited except as by the appended claims.

While this document contains many specifics, these should not be construed as limitations on the scope that is claimed or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Only a few implementations and examples are described, and other implementations, enhancements, and variations can be made based on what is described and illustrated in this disclosure.

What is claimed is:

1. A hinged panel system comprising:

a multi-hinged backing panel assembled with a plurality of elongated rectangular-shaped hinge flanges and a plurality of hinges;

wherein the plurality of elongated rectangular-shaped hinge flanges includes at least a first elongated rectangular-shaped hinge flange, a second elongated rectangular-shaped hinge flange, a third elongated rectangular-shaped hinge flange, and a fourth elongated rectangular-shaped hinge flange;

wherein the plurality of hinges includes at least a first hinge, a second hinge, and a third hinge;

an authoring medium;

wherein the multi-hinged backing panel and the authoring medium are connected;

a binding support that is configured to hold the multi-hinged backing panel and the authoring medium;

a top covering the multi-hinged backing panel and the authoring medium;

a fourth hinge, wherein one side of the fourth elongated rectangular-shaped hinge flange is connected to one side of the fourth hinge;

a fifth elongated rectangular-shaped hinge flange, wherein one side of the fifth hinge flange is connected to an opposite side of the fourth hinge;

a fifth hinge, wherein the opposite side of the fifth elongated rectangular-shaped hinge flange is connected to one side of the fifth hinge; and a sixth elongated rectangular-shaped hinge flange, wherein one side of the sixth elongated rectangular-shaped hinge flange is connected to the opposite side of the fifth hinge.

2. The system of claim 1, wherein the multi-hinged backing panel is positioned on a back side of the authoring medium.

3. The system of claim 1, wherein the multi-hinged backing panel is configured to provide support to the authoring medium.

4. The system of claim 1, wherein the third elongated rectangular-shaped hinge flange is of a same width as the authoring medium.

5. The system of claim 1, wherein each hinge is rotatable.

6. The system of claim 5, wherein each of the elongated rectangular-shaped hinge flange has a same length and thickness.

7. The system of claim 6, further comprising connective mediums attached to at least some of the plurality of elongated rectangular-shaped hinge flanges.

8. The system of claim 1 further comprising a locking mechanism;

wherein the locking mechanism is an extension of an upper portion of an elongated rectangular-shaped hinge flange;

wherein the locking mechanism is foldable.

9. The system of claim 1, wherein the system is an authoring pad.

10. A method of assembling the hinged panel system of claim 1, comprising attaching the multi-hinged backing panel to the authoring medium, the binding support and the top.

11. A multi-hinged panel, comprising:

a first elongated rectangular-shaped hinge flange;

a first hinge, wherein one side of the first elongated rectangular-shaped hinge flange is connected to one side of the first hinge;

a second elongated rectangular-shaped hinge flange, wherein one side of the second elongated rectangular-shaped hinge flange is connected to an opposite side of the first hinge;

a second hinge, wherein an opposite side of the second elongated rectangular-shaped hinge flange is connected to one side of the second hinge;

a third elongated rectangular-shaped hinge flange, wherein one side of the third elongated rectangular-shaped hinge flange is connected to the opposite side of the second hinge;

a third hinge, wherein the opposite side of the third elongated rectangular-shaped hinge flange is connected to one side of the third hinge;

a fourth elongated rectangular-shaped hinge flange, wherein one side of the fourth elongated rectangular-shaped hinge flange is connected to the opposite side of the third hinge;

a fourth hinge, wherein the opposite side of the fourth elongated rectangular-shaped hinge flange is connected to one side of the fourth hinge;

a fifth elongated rectangular-shaped hinge flange, wherein one side of the fifth elongated rectangular-shaped hinge flange is connected to the opposite side of the fourth hinge;

a fifth hinge, wherein the opposite side of the fifth elongated rectangular-shaped hinge flange is connected to one side of the fifth hinge; and a sixth elongated rectangular-shaped hinge flange, wherein one side of the sixth elongated rectangular-shaped hinge flange is connected to the opposite side of the fifth hinge.

12. The multi-hinged panel of claim 11, wherein the multi-hinged panel is on a back side of an authoring medium.

13. The multi-hinged panel of claim 12, wherein the multi-hinged panel is further configured to support the authoring medium.

14. The multi-hinged panel of claim 12, wherein the third elongated rectangular-shaped hinge flange is of a same width as the authoring medium.

15. The multi-hinged panel of claim 11, wherein each hinge is rotatable.

16. The multi-hinged panel of claim 11, wherein each elongated rectangular-shaped hinge flange is of same length and thickness.

17. The multi-hinged panel of claim 12, wherein an aggregated height of the fourth, fifth, and sixth elongated rectangular-shaped hinge flanges and the fourth, fifth, and sixth hinges is the same as the authoring medium;

wherein an aggregated height of the first, second, third, and fourth elongated rectangular-shaped hinge flanges and the first, second, third, and fourth hinges is the same as the authoring medium; and wherein an aggregated height of the first, second, and third elongated rectangular-shaped hinge flanges and the first, second, and third hinges is the same as an aggregated height of the fifth and sixth elongated rectangular-shaped hinge flanges and the fifth and sixth hinges.

18. The multi-hinged panel of claim 11 further comprising connective mediums;

wherein the connective mediums are attached to the first, second, fourth elongated rectangular-shaped hinge flanges and a front binding support.

19. The multi-hinged panel of claim 12, further comprising a locking mechanism;

wherein the locking mechanism is an extension of an upper portion of the fourth elongated rectangular-shaped hinge flange;

wherein the third elongated rectangular-shaped hinge flanges is equal to an aggregated width of the first elongated rectangular-shaped hinge flanges, the authoring medium, a binding support, and the locking mechanism;

wherein the locking mechanism is foldable.

20. The multi-hinged panel of claim 11, wherein each hinge is rotatable.

21. The multi-hinged panel of claim 11, wherein each elongated rectangular-shaped hinge flange is of same length and thickness.

22. A method of assembling the multi-hinged panel of claim 11, comprising fabricating the first elongated rectangular-shaped hinge flange, the second elongated rectangular-shaped hinge flange, the third elongated rectangular-shaped hinge flange, wherein one side of the third elongated rectangular-shaped hinge flange is connected to the opposite side of the second hinge.

* * * * *